US010701504B2

(12) United States Patent
Disch et al.

(10) Patent No.: US 10,701,504 B2
(45) **Date of Patent: *Jun. 30, 2020**

(54) APPARATUS AND METHOD FOR REALIZING A SAOC DOWNMIX OF 3D AUDIO CONTENT

(71) Applicant: Fraunhofer-Gesellschaft zur Foerderung der angewandten Forschung e.V., Munich (DE)

(72) Inventors: Sascha Disch, Fuerth (DE); Harald Fuchs, Roettenbach (DE); Oliver Hellmuth, Budenhof (DE); Juergen Herre, Erlangen (DE); Adrian Murtaza, Craiova (RO); Jouni Paulus, Nuremberg (DE); Falko Ridderbusch, Augsburg (DE); Leon Terentiv, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/611,673

(22) Filed: Jun. 1, 2017

(65) Prior Publication Data

US 2017/0272883 A1 Sep. 21, 2017

Related U.S. Application Data

(63) Continuation of application No. 15/004,629, filed on Jan. 22, 2016, now Pat. No. 9,699,584, which is a (Continued)

(30) Foreign Application Priority Data

Jul. 22, 2013 (EP) ..... 13177357
Jul. 22, 2013 (EP) ..... 13177371

(Continued)

(51) Int. Cl.
*H04S 3/02* (2006.01)
*G10L 19/008* (2013.01)

(Continued)

(52) U.S. Cl.
CPC ..... *H04S 3/02* (2013.01); *G10L 19/008* (2013.01); *H04S 3/00* (2013.01); *H04S 3/006* (2013.01);

(Continued)

(58) Field of Classification Search
CPC ..... H04S 2420/03; H04S 3/02; H04S 3/008; H04S 2400/03; H04S 2400/01;

(Continued)

(56) References Cited

U.S. PATENT DOCUMENTS 2,605,361 A 7/1952 Cutler
7,979,282 B2 7/2011 Lee et al.

(Continued)

FOREIGN PATENT DOCUMENTS

AU 2009206856 A1 7/2009
CN 1969317 A 5/2007

(Continued)

OTHER PUBLICATIONS

Herre, Jurgen et al., "New Concepts in Parametric Coding of Spatial Audio: From SAC to SAOC", IEEE International Conference on Multimedia and Expo; ISBN 978-1-4244-1016-3, Jul. 2-5, 2007, pp. 1894-1897.

(Continued)

*Primary Examiner* — Paul Kim
(74) *Attorney, Agent, or Firm* — Michael A. Glenn; Perkins Coie LLP

(57) ABSTRACT

An apparatus for generating one or more audio output channels is provided. The apparatus includes a parameter processor for calculating output channel mixing information and a downmix processor for generating the one or more audio output channels. The downmix processor is configured to receive an audio transport signal including one or more audio transport channels, wherein two or more audio (Continued)

object signals are mixed within the audio transport signal, and wherein the number of the one or more audio transport channels is smaller than the number of the two or more audio object signals. The audio transport signal depends on a first mixing rule and on a second mixing rule. The first mixing rule indicates how to mix the two or more audio object signals to obtain a plurality of premixed channels. Moreover, the second mixing rule indicates how to mix the plurality of premixed channels.

16 Claims, 11 Drawing Sheets

Related U.S. Application Data continuation of application No. PCT/EP2014/065290, filed on Jul. 16, 2014.

(30) Foreign Application Priority Data

Jul. 22, 2013 (EP) ..... 13177378
Oct. 18, 2013 (EP) ..... 13189281

(51) Int. Cl.
*H04S 3/00* (2006.01)
*H04S 7/00* (2006.01)

(52) U.S. Cl.
CPC ..... *H04S 3/008* (2013.01); *H04S 7/305* (2013.01); *H04S 2400/01* (2013.01); *H04S 2400/03* (2013.01); *H04S 2400/11* (2013.01); *H04S 2400/13* (2013.01); *H04S 2420/03* (2013.01)

(58) Field of Classification Search
CPC ..... H04S 3/00; H04S 2400/11; H04S 3/006; H04S 2400/13; H04S 7/305; G10L 19/008
USPC ..... 381/19, 20, 22, 23
See application file for complete search history.

(56) References Cited

U.S. PATENT DOCUMENTS 8,255,212 B2 8/2012 Villemoes
8,417,531 B2 4/2013 Lee et al.
8,504,184 B2 8/2013 Ishikawa et al.
8,504,377 B2 8/2013 Oh et al.
8,798,776 B2 8/2014 Schildbach
8,824,688 B2 9/2014 Schreiner et al.
9,167,346 B2 * 10/2015 Kraemer ..... G10L 19/00
9,530,421 B2 12/2016 Jot et al.
2004/0028125 A1 2/2004 Sato
2006/0083385 A1 4/2006 Allamanche et al.
2006/0136229 A1 6/2006 Kjoerling et al.
2006/0165184 A1 7/2006 Purnhagen et al.
2007/0063877 A1 3/2007 Shmunk et al.
2007/0121954 A1 5/2007 Kim et al.
2007/0280485 A1 12/2007 Villemoes
2008/0234845 A1 9/2008 Malvar et al.
2009/0006103 A1 1/2009 Koishida et al.
2009/0043591 A1 2/2009 Breebaart et al.
2009/0125313 A1 5/2009 Hellmuth et al.
2009/0125314 A1 5/2009 Hellmuth et al.
2009/0210239 A1 8/2009 Yoon et al.
2009/0271015 A1 10/2009 Oh et al.
2009/0278995 A1 11/2009 Oh
2009/0326958 A1 12/2009 Kim et al.
2010/0014680 A1 1/2010 Oh et al.
2010/0017195 A1 1/2010 Villemoes et al.
2010/0083344 A1 4/2010 Schildbach et al.
2010/0094631 A1 4/2010 Engdegard et al.
2010/0121647 A1 5/2010 Beack et al.
2010/0135510 A1 6/2010 Yoo et al.
2010/0153097 A1 6/2010 Hotho et al.
2010/0153118 A1 6/2010 Hotho et al.
2010/0174548 A1 * 7/2010 Beack ..... G10L 19/008 704/503
2010/0191354 A1 7/2010 Oh et al.
2010/0202620 A1 8/2010 Oh et al.
2010/0211400 A1 8/2010 Oh et al.
2010/0262420 A1 10/2010 Herre et al.
2010/0310081 A1 12/2010 Lien et al.
2010/0324915 A1 12/2010 Seo et al.
2011/0022402 A1 1/2011 Engdegard et al.
2011/0029113 A1 2/2011 Ishikawa et al.
2011/0182432 A1 7/2011 Ishikawa et al.
2011/0200198 A1 8/2011 Grill et al.
2011/0202355 A1 8/2011 Grill et al.
2011/0238425 A1 9/2011 Neuendorf et al.
2011/0293025 A1 12/2011 Mudulodu et al.
2011/0305344 A1 12/2011 Mateos Sole et al.
2012/0002818 A1 1/2012 Heiko et al.
2012/0057715 A1 3/2012 Johnston et al.
2012/0062700 A1 3/2012 Antonellis et al.
2012/0093213 A1 4/2012 Moriya et al.
2012/0143613 A1 6/2012 Herre et al.
2012/0183162 A1 7/2012 Robinson et al.
2012/0243690 A1 9/2012 Engdegard et al.
2012/0269353 A1 10/2012 Herre et al.
2012/0294449 A1 11/2012 Beack et al.
2012/0308049 A1 12/2012 Schreiner et al.
2012/0314875 A1 12/2012 Lee et al.
2012/0323584 A1 12/2012 Koishida et al.
2013/0132098 A1 5/2013 Beack et al.
2013/0246077 A1 9/2013 Riedmiller et al.
2014/0133682 A1 5/2014 Chabanne et al.
2014/0133683 A1 5/2014 Robinson et al.
2014/0257824 A1 9/2014 Taleb et al.
2014/0350944 A1 11/2014 Jot et al.
2016/0111099 A1 4/2016 Hirvonen et al.

FOREIGN PATENT DOCUMENTS

CN 101151660 A 3/2008
CN 101288115 A 10/2008
CN 101529501 A 9/2009
CN 101542595 A 9/2009
CN 101542596 A 9/2009
CN 101542597 A 9/2009
CN 101553865 A 10/2009
CN 101617360 A 12/2009
CN 101632118 A 1/2010
CN 101689368 A 3/2010
CN 101743586 A 6/2010
CN 101809654 A 8/2010
CN 101821799 A 9/2010
CN 101849257 A 9/2010
CN 101926181 A 12/2010
CN 101930741 A 12/2010
CN 102016981 A 4/2011
CN 102016982 A 4/2011
CN 102099856 A 6/2011
CN 102124517 A 7/2011
CN 102171754 A 8/2011
CN 102171755 A 8/2011
CN 102239520 A 11/2011
CN 102387005 A 3/2012
CN 102388417 A 3/2012
CN 102449689 A 5/2012
CN 102576532 A 7/2012
CN 102640213 A 8/2012
CN 102883257 A 1/2013
CN 102892070 A 1/2013
CN 102931969 A 2/2013
CN 102100088 B 10/2013
EP 2137824 A1 12/2009
EP 2194527 A2 6/2010
EP 2209328 A1 7/2010
EP 2479750 A1 7/2012

(56) References Cited

FOREIGN PATENT DOCUMENTS

| | | | |
|---|---|---|---|
| EP | 2560161 | A1 | 2/2013 |
| JP | 2010521013 | A | 6/2010 |
| JP | 2010525403 | A | 7/2010 |
| JP | 2011-008258 | A | 1/2011 |
| JP | 2013506164 | A | 2/2013 |
| JP | 2014-525048 | A | 9/2014 |
| KR | 20080029940 | A | 4/2008 |
| KR | 10-2010-0138716 | A | 12/2010 |
| KR | 1020110002489 | A | 1/2011 |
| RU | 2339088 | C1 | 11/2008 |
| RU | 2406166 | C2 | 12/2010 |
| RU | 2411594 | C2 | 2/2011 |
| RU | 2439719 | C2 | 1/2012 |
| RU | 2449387 | C2 | 4/2012 |
| RU | 2483364 | C2 | 5/2013 |
| TW | 200813981 | A | 3/2008 |
| TW | 200828269 | A | 7/2008 |
| TW | 201010450 | A | 3/2010 |
| TW | 201027517 | A | 7/2010 |
| WO | 2006048204 | A1 | 5/2006 |
| WO | 2008039042 | A1 | 4/2008 |
| WO | 2008046531 | A1 | 4/2008 |
| WO | 2008078973 | A1 | 7/2008 |
| WO | 2008111770 | A1 | 9/2008 |
| WO | 2008114982 | A1 | 9/2008 |
| WO | 2008131903 | A1 | 11/2008 |
| WO | 2009049895 | A1 | 4/2009 |
| WO | 2009049896 | A1 | 4/2009 |
| WO | 2010076040 | A1 | 7/2010 |
| WO | 2010105695 | A1 | 9/2010 |
| WO | 2011020067 | A1 | 2/2011 |
| WO | 2012072804 | A1 | 6/2012 |
| WO | 2012075246 | A2 | 6/2012 |
| WO | 2012/125855 | A1 | 9/2012 |
| WO | 2013006325 | A1 | 1/2013 |
| WO | 2013006330 | A2 | 1/2013 |
| WO | 2013006338 | A2 | 1/2013 |
| WO | 2013024085 | A1 | 2/2013 |
| WO | 2013064957 | A1 | 5/2013 |
| WO | 2013075753 | A1 | 5/2013 |
| WO | 2013006330 | A3 | 7/2013 |

OTHER PUBLICATIONS

Peters, N. et al., "SpatDIF: Principles, Specification, and Examples", Jun. 28, 2013, 6 pages.

"Information technology—MPEG audio technologies—Part 3: Unified speech and audio coding", ISO/IEC FDIS 23003-3:2011(E), Sep. 20, 2011, 291 pages.

"Extensible Markup Language (XML) 1.0 (Fifth Edition)", World Wide Web Consortium [online], http://www.w3.org/TR/2008/REC-xml-20081126/ (printout of internet site on Jun. 23, 2016), Nov. 26, 2008, 35 Pages.

"International Standard ISO/IEC 14772-1:1997—The Virtual Reality Modeling Language (VRML), Part 1: Functional specification and UTF-8 encoding", http://tecfa.unige.ch/guides/vrml/vrm197/spec/, 1997, 2 Pages.

"Synchronized Multimedia Integration Language (SMIL 3.0)", URL: http://www.w3.org/TR/2008/REC-SMIL3-20081201/, Dec. 2008, 200 Pages.

Chung, Y.-C. et al., "Dynamic Light Scattering of poly(vinyl alcohol)—borax aqueous solution near overlap concentration", Polymer Papers, vol. 38, No. 9., Elsevier Science Ltd., XP4058593A, 1997, pp. 2019-2025.

Douglas, D et al., "Algorithms for the Reduction of the Number of Points Required to Represent a Digitized Line or its Caricature", Cartographica: The International Journal for Geographic Information and Geovisualization 10.2, 1973, pp. 112-122.

Engdegard, J. et al., "Spatial Audio Object Coding (SAOC)—The Upcoming MPEG Standard on Parametric Object Based Audio Coding", 124th AES Convention, Audio Engineering Society, Paper 7377, May 17, 2008, pp. 1-15.

Geier, M. et al., "Object-based Audio Reproduction and the Audio Scene Description Format", Organised Sound, vol. 15, No. 3, Dec. 2010, pp. 219-227.

Herre, et al., "The Reference Model Architecture for MPEG Spatial Audio Coding", AES 118th Convention, Convention paper 6447, Barcelona, Spain, May 28-31, 2005, 13 pages.

Herre, J. et al., "From SAC To SAOC—Recent Developments in Parametric Coding of Spatial Audio", Fraunhofer Institute for Integrated Circuits, Illusions in Sound, AES 22nd UK Conference 2007,, Apr. 2007, pp. 12-1 through 12-8.

ISO/IEC, , "MPEG audio technologies—Part 2: Spatial Audio Object Coding (SAOC)", ISO/IEC JTC1/SC29/WG11 (MPEG) International Standard 23003-2., Oct. 1, 2010, pp. 1-130.

ITU-T, "Information technology—Generic coding of moving pictures and associated audio information: Systems", Series H: Audiovisual and Multimedia Systems; ITU-T Recommendation H.222.0, May 2012, 234 pages.

MPEG, "Information technology—Coding of audio-visual objects, Part 3 Audio", ISO/IEC 14496-3:2009(E), International Standard, Forth edition, 2009, 1416 Pages.

Peters, N. et al., "SpatDIF: Principles, Specification, and Examples", Proceedings of the 9th Sound and Music Computing Conference, Copenhagen, Denmark, Jul. 11-14, 2012, SMC2012-500 through SMC2012-505.

Peters, N. et al., "The Spatial Sound Description Interchange Format: Principles, Specification, and Examples", Computer Music Journal, 37:1, XP055137982, DOI: 10.1162/COMJ_a_00167, Retrieved from the Internet: URL:http://www.mitpressjournals.org/doi/pdfplus/10.1162/COMJ_a_00167 [retrieved on Sep. 3, 2014], May 3, 2013, pp. 1-22.

Pulkki, V et al., "Virtual Sound Source Positioning Using Vector Base Amplitude Panning", Journal of Audio Eng. Soc. vol. 45, No. 6., Jun. 1997, 456-466.

Ramer, U , "An Iterative Procedure", Computer Graphics and Image, vol. 1, 1972, pp. 244-256.

Schmidt, J et al., "New and Advanced Features for Audio Presentation in the MPEG-4 Standard", 116th AES Convention, Berlin, Germany, May 2004, pp. 1-13.

Sperschneider, R. , "Text of ISO/IEC13818-7:2004 (MPEG-2 AAC 3rd edition)", ISO/IEC JTC1/SC29/WG11 N6428, Munich, Germany Mar. 2004, pp. 1-198.

Sporer, T , "Codierung räumlicher Audiosignale mit leichtgewichtigen Audio-Objekten", Proc. Annual Meeting of the German Audiological Society (DGA), Erlangen, Germany, Mar. 2012, 22 Pages.

Wright, M. et al., "Open SoundControl: A New Protocol for Communicating with Sound Synthesizers", Proceedings of the 1997 International Computer Music Conference, vol. 2013, No. 8, 1997, 5 pages.

"Information technology—Generic coding of moving pictures and associated audio information—Part 7: Advanced Audio Coding (AAC)", ISO/IEC 13818-7:2004(E), Third edition, Oct. 15, 2004, 206 pages.

Herre, et al., "MPEG Spatial Audio Object Coding—The ISO/MPEG Standard for Efficient Coding of Interactive Audio Scenes", J. Audio Eng. Soc. vol. 60, No. 9, Sep. 2012, pp. 655-673.

Herre, Jurgen et al., "MPEG Surround—the ISO/MPEG Standard for Efficient and Compatible Multi-Channel Audio Coding", AES Convention 122, Convention Paper 7084, XP040508156, May 5-8, 2007, pp. 1-23.

"Information technology—Generic Coding of Moving Pictures and Associated Audio Information", ISO/IEC 13818-7, MPEG-2 AAC 3rd edition, ISO/IEC JTC1/SC29/WG11 N6428, Mar. 2004, 1-206.

Jeroen Breebaart, et al., "Spatial Audio Object Coding (SAOC)—The Upcoming MPEG Standard on Parametric Object Based Audio Coding", AES Convention 124, May 2008, pp. 1-15.

Christian R. Helmrich, et al., "Efficient transform coding of two-channel audio signals by means of complex-valued stereo prediction", Acoustics, Speech and Signal Processing (ICASSP), May 22, 2011, IEEE International Conference, pp. 497-500.

(56) References Cited

OTHER PUBLICATIONS

"Information technology—Generic coding of moving pictures and associated audio information—Part 7: Advanced Audio Coding (AAC)", ISO/IEC 13818-7, Part 7 MPEG-2AAC, Aug. 2003, 198 pages.
ISO/IEC 23003-3, "Information Technology—MPEG audio technologies—Part 3: Unified Speech and Audio Coding", International Standard, ISO/IEC FDIS 23003-3, Nov. 23, 2011, 286 pages.
Max Neuendorf, et al., "MPEG Unified Speech and Audio Coding—The ISO/MPEG Standard for High-Efficiency Audio Coding of all Content Types", Audio Engineering Society Convention Paper 8654, Presented at the 132nd Convention, Apr. 26-29, 2012, pp. 1-22.
JM Valin, et al., "Definition of the Opus Audio Codec", IETF, Sep. 2012, pp. 1-326.

* cited by examiner (ENCODER)

(DECODER)

(ENCODER)

(DECODER)

(ENCODER)

(DECODER)

APPARATUS AND METHOD FOR REALIZING A SAOC DOWNMIX OF 3D AUDIO CONTENT

CROSS-REFERENCE TO RELATED APPLICATIONS

This application is a continuation of copending U.S. patent application Ser. No. 15/004,629, filed Jan. 22, 2016, which is a continuation of International Application No. PCT/EP2014/065290, filed Jul. 16, 2014, which claims priority from European Applications Nos. EP 13177371, filed Jul. 22, 2013, EP 13177357, filed Jul. 22, 2013, EP 13177378, filed Jul. 22, 2013, and EP 13189281, filed Oct. 18, 2013, which are each incorporated herein in its entirety by this reference thereto.

The present invention is related to audio encoding/decoding, in particular, to spatial audio coding and spatial audio object coding, and, more particularly, to an apparatus and method for realizing a SAOC downmix of 3D audio content and to an apparatus and method for efficiently decoding the SAOC downmix of 3D audio content.

BACKGROUND OF THE INVENTION

Spatial audio coding tools are well-known in the art and are, for example, standardized in the MPEG-surround standard. Spatial audio coding starts from original input channels such as five or seven channels which are identified by their placement in a reproduction setup, i.e., a left channel, a center channel, a right channel, a left surround channel, a right surround channel and a low frequency enhancement channel. A spatial audio encoder typically derives one or more downmix channels from the original channels and, additionally, derives parametric data relating to spatial cues such as interchannel level differences, interchannel phase differences, interchannel time differences, etc. The one or more downmix channels are transmitted together with the parametric side information indicating the spatial cues to a spatial audio decoder which decodes the downmix channel and the associated parametric data in order to finally obtain output channels which are an approximated version of the original input channels. The placement of the channels in the output setup is typically fixed and is, for example, a 5.1 format, a 7.1 format, etc.

Such channel-based audio formats are widely used for storing or transmitting multi-channel audio content where each channel relates to a specific loudspeaker at a given position. A faithful reproduction of these kind of formats involves a loudspeaker setup where the speakers are placed at the same positions as the speakers that were used during the production of the audio signals. While increasing the number of loudspeakers improves the reproduction of truly immersive 3D audio scenes, it becomes more and more difficult to fulfill this requirement—especially in a domestic environment like a living room.

The necessity of having a specific loudspeaker setup can be overcome by an object-based approach where the loudspeaker signals are rendered specifically for the playback setup.

For example, spatial audio object coding tools are well-known in the art and are standardized in the MPEG SAOC standard (SAOC=Spatial Audio Object Coding). In contrast to spatial audio coding starting from original channels, spatial audio object coding starts from audio objects which are not automatically dedicated for a certain rendering reproduction setup. Instead, the placement of the audio objects in the reproduction scene is flexible and can be determined by the user by inputting certain rendering information into a spatial audio object coding decoder. Alternatively or additionally, rendering information, i.e., information at which position in the reproduction setup a certain audio object is to be placed typically over time can be transmitted as additional side information or metadata. In order to obtain a certain data compression, a number of audio objects are encoded by an SAOC encoder which calculates, from the input objects, one or more transport channels by downmixing the objects in accordance with certain downmixing information. Furthermore, the SAOC encoder calculates parametric side information representing inter-object cues such as object level differences (OLD), object coherence values, etc. The inter object parametric data is calculated for parameter time/frequency tiles, i.e., for a certain frame of the audio signal comprising, for example, 1024 or 2048 samples, 28, 20, 14 or 10, etc., processing bands are considered so that, in the end, parametric data exists for each frame and each processing band. As an example, when an audio piece has 20 frames and when each frame is subdivided into 28 processing bands, then the number of time/frequency tiles is 560.

In an object-based approach, the sound field is described by discrete audio objects. This involves object metadata that describes among others the time-variant position of each sound source in 3D space.

A first metadata coding concept in conventional technology is the spatial sound description interchange format (SpatDIF), an audio scene description format which is still under development [M1]. It is designed as an interchange format for object-based sound scenes and does not provide any compression method for object trajectories. SpatDIF uses the text-based Open Sound Control (OSC) format to structure the object metadata [M2]. A simple text-based representation, however, is not an option for the compressed transmission of object trajectories.

Another metadata concept in conventional technology is the Audio Scene Description Format (ASDF) [M3], a text-based solution that has the same disadvantage. The data is structured by an extension of the Synchronized Multimedia Integration Language (SMIL) which is a sub set of the Extensible Markup Language (XML) [M4], [M5].

A further metadata concept in conventional technology is the audio binary format for scenes (AudioBIFS), a binary format that is part of the MPEG-4 specification [M6], [M7]. It is closely related to the XML-based Virtual Reality Modeling Language (VRML) which was developed for the description of audio-visual 3D scenes and interactive virtual reality applications [M8]. The complex AudioBIFS specification uses scene graphs to specify routes of object movements. A major disadvantage of AudioBIFS is that is not designed for real-time operation where a limited system delay and random access to the data stream are a requirement. Furthermore, the encoding of the object positions does not exploit the limited localization performance of human listeners. For a fixed listener position within the audio-visual scene, the object data can be quantized with a much lower number of bits [M9]. Hence, the encoding of the object metadata that is applied in AudioBIFS is not efficient with regard to data compression.

SUMMARY

According to an embodiment, an apparatus for generating one or more audio output channels may have: a parameter processor for calculating output channel mixing information, and a downmix processor for generating the one or more audio output channels, wherein the downmix processor is configured to receive an audio transport signal including one or more audio transport channels, wherein two or more audio object signals are mixed within the audio transport signal, and wherein the number of the one or more audio transport channels is smaller than the number of the two or more audio object signals, wherein the audio transport signal depends on a first mixing rule and on a second mixing rule, wherein the first mixing rule indicates how to mix the two or more audio object signals to acquire a plurality of premixed channels, and wherein the second mixing rule indicates how to mix the plurality of premixed channels to acquire the one or more audio transport channels of the audio transport signal, wherein the parameter processor is configured to receive information on the second mixing rule, wherein the information on the second mixing rule indicates how to mix the plurality of premixed signals such that the one or more audio transport channels are acquired, wherein the parameter processor is configured to calculate the output channel mixing information depending on an audio objects number indicating the number of the two or more audio object signals, depending on a premixed channels number indicating the number of the plurality of premixed channels, and depending on the information on the second mixing rule, and wherein the downmix processor is configured to generate the one or more audio output channels from the audio transport signal depending on the output channel mixing information.

According to another embodiment, an apparatus for generating an audio transport signal including one or more audio transport channels may have: an object mixer for generating the audio transport signal including the one or more audio transport channels from two or more audio object signals, such that the two or more audio object signals are mixed within the audio transport signal, and wherein the number of the one or more audio transport channels is smaller than the number of the two or more audio object signals, and an output interface for outputting the audio transport signal, wherein the apparatus is configured to transmit the audio transport signal to a decoder, wherein the object mixer is configured to generate the one or more audio transport channels of the audio transport signal depending on a first mixing rule and depending on a second mixing rule, wherein the first mixing rule indicates how to mix the two or more audio object signals to acquire a plurality of premixed channels, and wherein the second mixing rule indicates how to mix the plurality of premixed channels to acquire the one or more audio transport channels of the audio transport signal, wherein the first mixing rule depends on an audio objects number, indicating the number of the two or more audio object signals, and depends on a premixed channels number, indicating the number of the plurality of premixed channels, and wherein the second mixing rule depends on the premixed channels number, and wherein object mixer is configured to generate the one or more audio transport channels of the audio transport signal depending on a first matrix, wherein the first matrix indicates how to mix the two or more audio object signals to acquire the plurality of premixed channels, and depending on a second matrix, wherein the second matrix indicates how to mix the plurality of premixed channels to acquire the one or more audio transport channels of the audio transport signal, wherein first coefficients of the first matrix indicate information on the first mixing rule, and wherein second coefficients of the second matrix indicate information on the second mixing rule, wherein the apparatus is configured to transmit the second coefficients of the second mixing matrix to the decoder, and wherein the apparatus is configured to not transmit the first coefficients of the first mixing matrix to the decoder.

According to another embodiment, a system may have: an apparatus for generating an audio transport signal including one or more audio transport channels, which apparatus may have: an object mixer for generating the audio transport signal including the one or more audio transport channels from two or more audio object signals, such that the two or more audio object signals are mixed within the audio transport signal, and wherein the number of the one or more audio transport channels is smaller than the number of the two or more audio object signals, and an output interface for outputting the audio transport signal, wherein the apparatus is configured to transmit the audio transport signal to a decoder, wherein the object mixer is configured to generate the one or more audio transport channels of the audio transport signal depending on a first mixing rule and depending on a second mixing rule, wherein the first mixing rule indicates how to mix the two or more audio object signals to acquire a plurality of premixed channels, and wherein the second mixing rule indicates how to mix the plurality of premixed channels to acquire the one or more audio transport channels of the audio transport signal, wherein the first mixing rule depends on an audio objects number, indicating the number of the two or more audio object signals, and depends on a premixed channels number, indicating the number of the plurality of premixed channels, and wherein the second mixing rule depends on the premixed channels number, and wherein object mixer is configured to generate the one or more audio transport channels of the audio transport signal depending on a first matrix, wherein the first matrix indicates how to mix the two or more audio object signals to acquire the plurality of premixed channels, and depending on a second matrix, wherein the second matrix indicates how to mix the plurality of premixed channels to acquire the one or more audio transport channels of the audio transport signal, wherein first coefficients of the first matrix indicate information on the first mixing rule, and wherein second coefficients of the second matrix indicate information on the second mixing rule, wherein the apparatus is configured to transmit the second coefficients of the second mixing matrix to the decoder, and wherein the apparatus is configured to not transmit the first coefficients of the first mixing matrix to the decoder, and an apparatus for generating one or more audio output channels, which apparatus may have: a parameter processor for calculating output channel mixing information, and a downmix processor for generating the one or more audio output channels, wherein the downmix processor is configured to receive an audio transport signal including one or more audio transport channels, wherein two or more audio object signals are mixed within the audio transport signal, and wherein the number of the one or more audio transport channels is smaller than the number of the two or more audio object signals, wherein the audio transport signal depends on a first mixing rule and on a second mixing rule, wherein the first mixing rule indicates how to mix the two or more audio object signals to acquire a plurality of premixed channels, and wherein the second mixing rule indicates how to mix the plurality of premixed channels to acquire the one or more audio transport channels of the audio transport signal, wherein the parameter processor is configured to receive information on the second mixing rule, wherein the information on the second mixing rule indicates how to mix the plurality of premixed signals such that the one or more audio transport channels are acquired, wherein the parameter processor is configured to calculate the output channel mixing information depending on an audio objects number indicating the number of the two or more audio object signals, depending on a premixed channels number indicating the number of the plurality of premixed channels, and depending on the information on the second mixing rule, and wherein the downmix processor is configured to generate the one or more audio output channels from the audio transport signal depending on the output channel mixing information, wherein the apparatus for generating one or more audio output channels is configured to receive the audio transport signal and information on the second mixing rule from the apparatus for generating an audio transport signal, and wherein the apparatus for generating one or more audio output channels is configured to generate the one or more audio output channels from the audio transport signal depending on the information on the second mixing rule.

According to another embodiment, a method for generating one or more audio output channels may have the steps of: receiving an audio transport signal including one or more audio transport channels, wherein two or more audio object signals are mixed within the audio transport signal, and wherein the number of the one or more audio transport channels is smaller than the number of the two or more audio object signals, wherein the audio transport signal depends on a first mixing rule and on a second mixing rule, wherein the first mixing rule indicates how to mix the two or more audio object signals to acquire a plurality of premixed channels, and wherein the second mixing rule indicates how to mix the plurality of premixed channels to acquire the one or more audio transport channels of the audio transport signal, receiving information on the second mixing rule, wherein the information on the second mixing rule indicates how to mix the plurality of premixed signals such that the one or more audio transport channels are acquired, calculating output channel mixing information depending on an audio objects number indicating the number of the two or more audio object signals, depending on a premixed channels number indicating the number of the plurality of premixed channels, and depending on the information on the second mixing rule, and generating one or more audio output channels from the audio transport signal depending on the output channel mixing information.

According to another embodiment, a method for generating an audio transport signal including one or more audio transport channels may have the steps of: generating the audio transport signal including the one or more audio transport channels from two or more audio object signals, outputting the audio transport signal, and transmitting the audio transport signal to a decoder, and transmitting second coefficients of a second mixing matrix to the decoder, and not transmitting first coefficients of a first mixing matrix to the decoder, wherein generating the audio transport signal including the one or more audio transport channels from two or more audio object signals is conducted such that the two or more audio object signals are mixed within the audio transport signal, wherein the number of the one or more audio transport channels is smaller than the number of the two or more audio object signals, and wherein generating the one or more audio transport channels of the audio transport signal is conducted depending on a first mixing rule and depending on a second mixing rule, wherein the first mixing rule indicates how to mix the two or more audio object signals to acquire a plurality of premixed channels, and wherein the second mixing rule indicates how to mix the plurality of premixed channels to acquire the one or more audio transport channels of the audio transport signal, wherein the first mixing rule depends on an audio objects number, indicating the number of the two or more audio object signals, and depends on a premixed channels number, indicating the number of the plurality of premixed channels, and wherein the second mixing rule depends on the premixed channels number, wherein generating the one or more audio transport channels of the audio transport signal depending on the first matrix, wherein the first matrix indicates how to mix the two or more audio object signals to acquire the plurality of premixed channels, and depending on the second matrix, wherein the second matrix indicates how to mix the plurality of premixed channels to acquire the one or more audio transport channels of the audio transport signal, wherein the first coefficients of the first matrix indicate information on the first mixing rule, and wherein the second coefficients of the second matrix indicate information on the second mixing rule.

According to another embodiment, a non-transitory digital storage medium may have computer-readable code stored thereon to perform the inventive methods when said storage medium is run by a computer or signal processor.

According to embodiments, efficient transportation is realized and means how to decode the downmix for 3D audio content are provided.

An apparatus for generating one or more audio output channels is provided. The apparatus comprises a parameter processor for calculating output channel mixing information and a downmix processor for generating the one or more audio output channels. The downmix processor is configured to receive an audio transport signal comprising one or more audio transport channels, wherein two or more audio object signals are mixed within the audio transport signal, and wherein the number of the one or more audio transport channels is smaller than the number of the two or more audio object signals. The audio transport signal depends on a first mixing rule and on a second mixing rule. The first mixing rule indicates how to mix the two or more audio object signals to obtain a plurality of premixed channels. Moreover, the second mixing rule indicates how to mix the plurality of premixed channels to obtain the one or more audio transport channels of the audio transport signal. The parameter processor is configured to receive information on the second mixing rule, wherein the information on the second mixing rule indicates how to mix the plurality of premixed signals such that the one or more audio transport channels are obtained. Moreover, the parameter processor is configured to calculate the output channel mixing information depending on an audio objects number indicating the number of the two or more audio object signals, depending on a premixed channels number indicating the number of the plurality of premixed channels, and depending on the information on the second mixing rule. The downmix processor is configured to generate the one or more audio output channels from the audio transport signal depending on the output channel mixing information.

Moreover, an apparatus for generating an audio transport signal comprising one or more audio transport channels is provided. The apparatus comprises an object mixer for generating the audio transport signal comprising the one or more audio transport channels from two or more audio object signals, such that the two or more audio object signals are mixed within the audio transport signal, and wherein the number of the one or more audio transport channels is smaller than the number of the two or more audio object signals, and an output interface for outputting the audio transport signal. The object mixer is configured to generate the one or more audio transport channels of the audio transport signal depending on a first mixing rule and depending on a second mixing rule, wherein the first mixing rule indicates how to mix the two or more audio object signals to obtain a plurality of premixed channels, and wherein the second mixing rule indicates how to mix the plurality of premixed channels to obtain the one or more audio transport channels of the audio transport signal. The first mixing rule depends on an audio objects number, indicating the number of the two or more audio object signals, and depends on a premixed channels number, indicating the number of the plurality of premixed channels, and wherein the second mixing rule depends on the premixed channels number. The output interface is configured to output information on the second mixing rule.

Furthermore, a system is provided. The system comprises an apparatus for generating an audio transport signal as described above and an apparatus for generating one or more audio output channels as described above. The apparatus for generating one or more audio output channels is configured to receive the audio transport signal and information on the second mixing rule from the apparatus for generating an audio transport signal. Moreover, the apparatus for generating one or more audio output channels is configured to generate the one or more audio output channels from the audio transport signal depending on the information on the second mixing rule.

Furthermore, a method for generating one or more audio output channels is provided. The method comprises:

Receiving an audio transport signal comprising one or more audio transport channels, wherein two or more audio object signals are mixed within the audio transport signal, and wherein the number of the one or more audio transport channels is smaller than the number of the two or more audio object signals, wherein the audio transport signal depends on a first mixing rule and on a second mixing rule, wherein the first mixing rule indicates how to mix the two or more audio object signals to obtain a plurality of premixed channels, and wherein the second mixing rule indicates how to mix the plurality of premixed channels to obtain the one or more audio transport channels of the audio transport signal.

Receiving information on the second mixing rule, wherein the information on the second mixing rule indicates how to mix the plurality of premixed signals such that the one or more audio transport channels are obtained.

Calculating output channel mixing information depending on an audio objects number indicating the number of the two or more audio object signals, depending on a premixed channels number indicating the number of the plurality of premixed channels, and depending on the information on the second mixing rule. And:

Generating one or more audio output channels from the audio transport signal depending on the output channel mixing information.

Moreover, a method for generating an audio transport signal comprising one or more audio transport channels is provided. The method comprises:

Generating the audio transport signal comprising the one or more audio transport channels from two or more audio object signals.

Outputting the audio transport signal. And:

Outputting information on the second mixing rule.

Generating the audio transport signal comprising the one or more audio transport channels from two or more audio object signals is conducted such that the two or more audio object signals are mixed within the audio transport signal, wherein the number of the one or more audio transport channels is smaller than the number of the two or more audio object signals. Generating the one or more audio transport channels of the audio transport signal is conducted depending on a first mixing rule and depending on a second mixing rule, wherein the first mixing rule indicates how to mix the two or more audio object signals to obtain a plurality of premixed channels, and wherein the second mixing rule indicates how to mix the plurality of premixed channels to obtain the one or more audio transport channels of the audio transport signal. The first mixing rule depends on an audio objects number, indicating the number of the two or more audio object signals, and depends on a premixed channels number, indicating the number of the plurality of premixed channels. The second mixing rule depends on the premixed channels number.

Moreover, a computer program for implementing the above-described method when being executed on a computer or signal processor is provided.

BRIEF DESCRIPTION OF THE DRAWINGS

Embodiments of the present invention will be detailed subsequently referring to the appended drawings, in which.

DETAILED DESCRIPTION OF THE INVENTION

Before describing advantageous embodiments of the present invention in detail, the new 3D Audio Codec System is described.

In conventional technology, no flexible technology exists combining channel coding on the one hand and object coding on the other hand so that acceptable audio qualities at low bit rates are obtained.

This limitation is overcome by the new 3D Audio Codec System.

Before describing advantageous embodiments in detail, the new 3D Audio Codec System is described.

Figure 4:
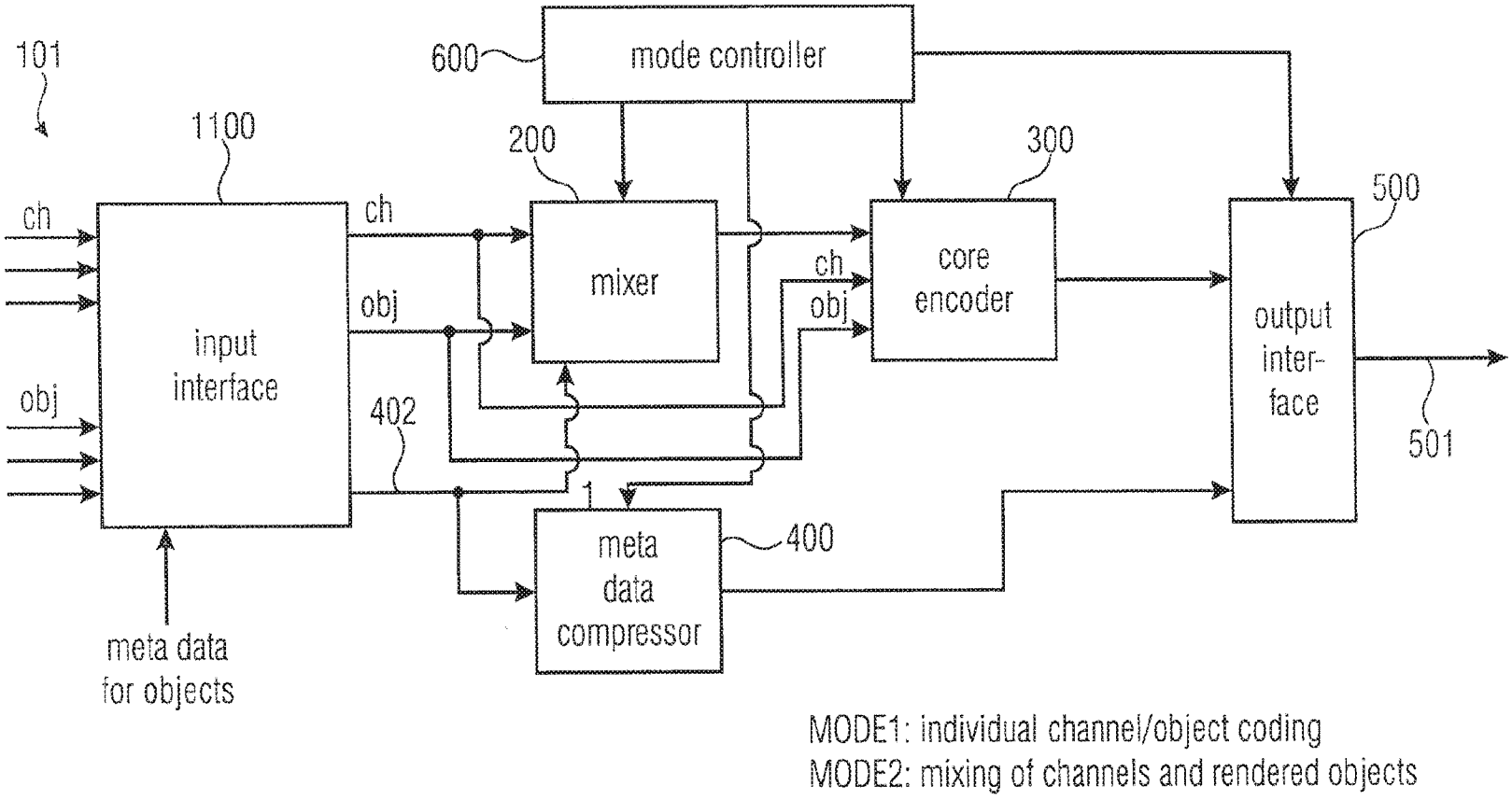
FIG. 4 illustrates a first embodiment of a 3D audio encoder.

FIG. 4 illustrates a 3D audio encoder in accordance with an embodiment of the present invention. The 3D audio encoder is configured for encoding audio input data 101 to obtain audio output data 501. The 3D audio encoder comprises an input interface for receiving a plurality of audio channels indicated by CH and a plurality of audio objects indicated by OBJ. Furthermore, as illustrated in FIG. 4, the input interface 1100 additionally receives metadata related to one or more of the plurality of audio objects OBJ. Furthermore, the 3D audio encoder comprises a mixer 200 for mixing the plurality of objects and the plurality of channels to obtain a plurality of pre-mixed channels, wherein each pre-mixed channel comprises audio data of a channel and audio data of at least one object.

Furthermore, the 3D audio encoder comprises a core encoder 300 for core encoding core encoder input data, a metadata compressor 400 for compressing the metadata related to the one or more of the plurality of audio objects.

Furthermore, the 3D audio encoder can comprise a mode controller 600 for controlling the mixer, the core encoder and/or an output interface 500 in one of several operation modes, wherein in the first mode, the core encoder is configured to encode the plurality of audio channels and the plurality of audio objects received by the input interface 1100 without any interaction by the mixer, i.e., without any mixing by the mixer 200. In a second mode, however, in which the mixer 200 was active, the core encoder encodes the plurality of mixed channels, i.e., the output generated by block 200. In this latter case, it is advantageous to not encode any object data anymore. Instead, the metadata indicating positions of the audio objects are already used by the mixer 200 to render the objects onto the channels as indicated by the metadata. In other words, the mixer 200 uses the metadata related to the plurality of audio objects to pre-render the audio objects and then the pre-rendered audio objects are mixed with the channels to obtain mixed channels at the output of the mixer. In this embodiment, any objects may not necessarily be transmitted and this also applies for compressed metadata as output by block 400. However, if not all objects input into the interface 1100 are mixed but only a certain amount of objects is mixed, then only the remaining non-mixed objects and the associated metadata nevertheless are transmitted to the core encoder 300 or the metadata compressor 400, respectively.

Figure 6:
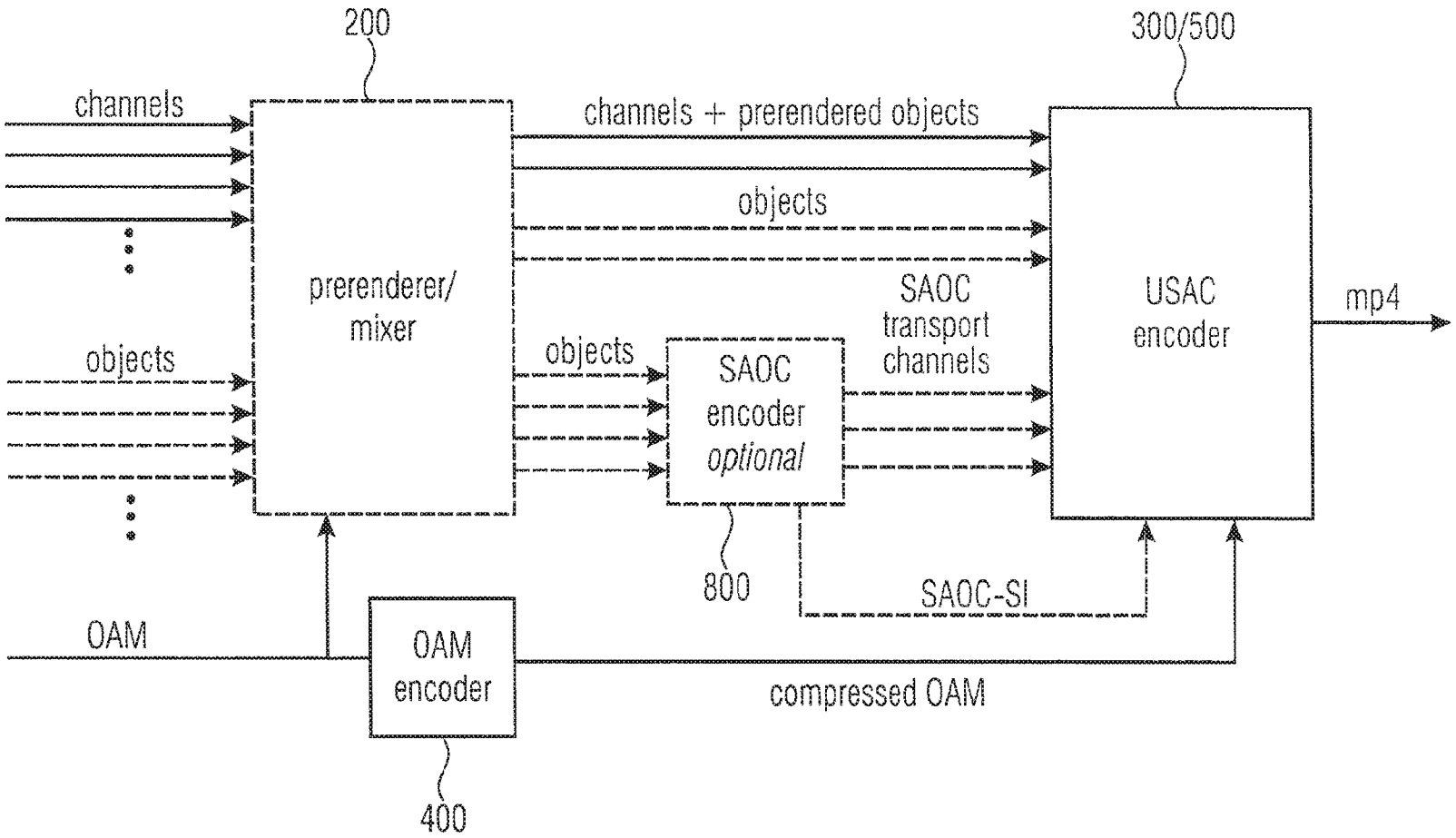
FIG. 6 illustrates a second embodiment of a 3D audio encoder.

FIG. 6 illustrates a further embodiment of an 3D audio encoder which, additionally, comprises an SAOC encoder 800. The SAOC encoder 800 is configured for generating one or more transport channels and parametric data from spatial audio object encoder input data. As illustrated in FIG. 6, the spatial audio object encoder input data are objects which have not been processed by the pre-renderer/mixer. Alternatively, provided that the pre-renderer/mixer has been bypassed as in the mode one where an individual channel/object coding is active, all objects input into the input interface 1100 are encoded by the SAOC encoder 800.

Furthermore, as illustrated in FIG. 6, the core encoder 300 is advantageously implemented as a USAC encoder, i.e., as an encoder as defined and standardized in the MPEG-USAC standard (USAC=Unified Speech and Audio Coding). The output of the whole 3D audio encoder illustrated in FIG. 6 is an MPEG 4 data stream, MPEG H data stream or 3D audio data stream, having the container-like structures for individual data types. Furthermore, the metadata is indicated as "OAM" data and the metadata compressor 400 in FIG. 4 corresponds to the OAM encoder 400 to obtain compressed OAM data which are input into the USAC encoder 300 which, as can be seen in FIG. 6, additionally comprises the output interface to obtain the MP4 output data stream not only having the encoded channel/object data but also having the compressed OAM data.

Figure 8:
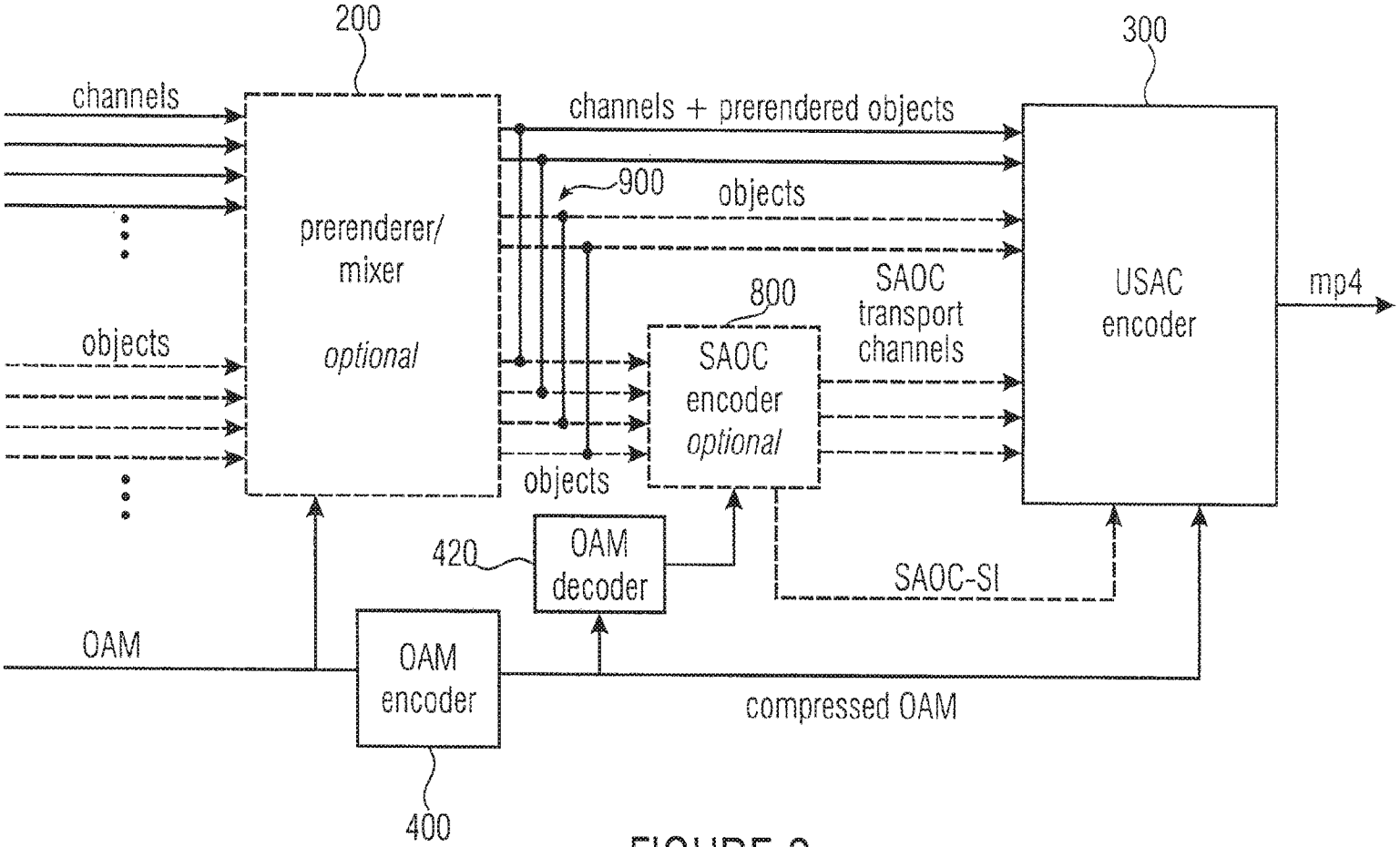
FIG. 8 illustrates a third embodiment of a 3D audio encoder.

FIG. 8 illustrates a further embodiment of the 3D audio encoder, where in contrast to FIG. 6, the SAOC encoder can be configured to either encode, with the SAOC encoding algorithm, the channels provided at the pre-renderer/mixer 200 not being active in this mode or, alternatively, to SAOC encode the pre-rendered channels plus objects. Thus, in FIG. 8, the SAOC encoder 800 can operate on three different kinds of input data, i.e., channels without any pre-rendered objects, channels and pre-rendered objects or objects alone. Furthermore, it is advantageous to provide an additional OAM decoder 420 in FIG. 8 so that the SAOC encoder 800 uses, for its processing, the same data as on the decoder side, i.e., data obtained by a lossy compression rather than the original OAM data.

The FIG. 8 3D audio encoder can operate in several individual modes.

In addition to the first and the second modes as discussed in the context of FIG. 4, the FIG. 8 3D audio encoder can additionally operate in a third mode in which the core encoder generates the one or more transport channels from the individual objects when the pre-renderer/mixer 200 was not active. Alternatively or additionally, in this third mode the SAOC encoder 800 can generate one or more alternative or additional transport channels from the original channels, i.e., again when the pre-renderer/mixer 200 corresponding to the mixer 200 of FIG. 4 was not active.

Figure 3:
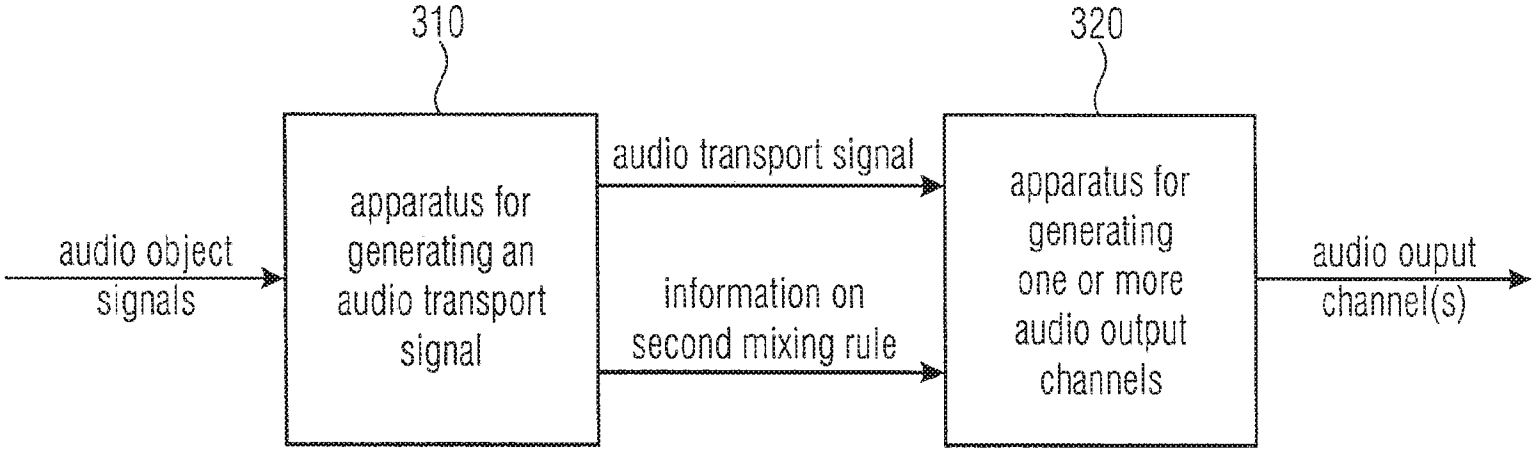
FIG. 3 illustrates a system according to an embodiment.

Finally, the SAOC encoder 800 can encode, when the 3D audio encoder is configured in the fourth mode, the channels plus pre-rendered objects as generated by the pre-renderer/mixer. Thus, in the fourth mode the lowest bit rate applications will provide good quality due to the fact that the channels and objects have completely been transformed into individual SAOC transport channels and associated side information as indicated in FIGS. 3 and 5 as "SAOC-SI" and, additionally, any compressed metadata do not have to be transmitted in this fourth mode.

Figure 5:
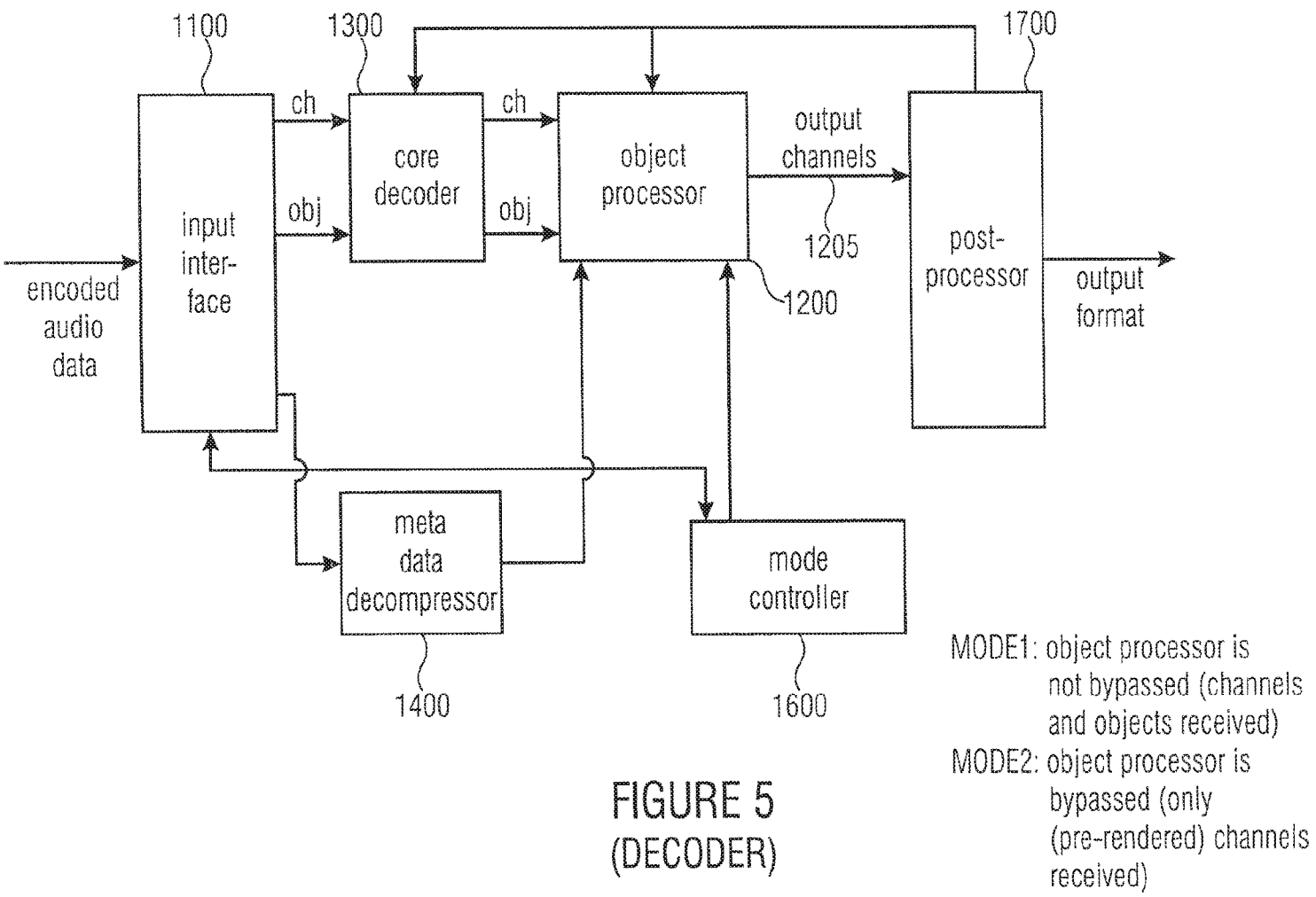
FIG. 5 illustrates a first embodiment of a 3D audio decoder.

FIG. 5 illustrates a 3D audio decoder in accordance with an embodiment of the present invention. The 3D audio decoder receives, as an input, the encoded audio data, i.e., the data 501 of FIG. 4.

The 3D audio decoder comprises a metadata decompressor 1400, a core decoder 1300, an object processor 1200, a mode controller 1600 and a postprocessor 1700.

Specifically, the 3D audio decoder is configured for decoding encoded audio data and the input interface is configured for receiving the encoded audio data, the encoded audio data comprising a plurality of encoded channels and the plurality of encoded objects and compressed metadata related to the plurality of objects in a certain mode.

Furthermore, the core decoder 1300 is configured for decoding the plurality of encoded channels and the plurality of encoded objects and, additionally, the metadata decompressor is configured for decompressing the compressed metadata.

Furthermore, the object processor 1200 is configured for processing the plurality of decoded objects as generated by the core decoder 1300 using the decompressed metadata to obtain a predetermined number of output channels comprising object data and the decoded channels. These output channels as indicated at 1205 are then input into a postprocessor 1700. The postprocessor 1700 is configured for converting the number of output channels 1205 into a certain output format which can be a binaural output format or a loudspeaker output format such as a 5.1, 7.1, etc., output format.

Advantageously, the 3D audio decoder comprises a mode controller 1600 which is configured for analyzing the encoded data to detect a mode indication. Therefore, the mode controller 1600 is connected to the input interface 1100 in FIG. 5. However, alternatively, the mode controller does not necessarily have to be there. Instead, the flexible audio decoder can be pre-set by any other kind of control data such as a user input or any other control. The 3D audio decoder in FIG. 5 and, advantageously controlled by the mode controller 1600, is configured to either bypass the object processor and to feed the plurality of decoded channels into the postprocessor 1700. This is the operation in mode 2, i.e., in which only pre-rendered channels are received, i.e., when mode 2 has been applied in the 3D audio encoder of FIG. 4. Alternatively, when mode 1 has been applied in the 3D audio encoder, i.e., when the 3D audio encoder has performed individual channel/object coding, then the object processor 1200 is not bypassed, but the plurality of decoded channels and the plurality of decoded objects are fed into the object processor 1200 together with decompressed metadata generated by the metadata decompressor 1400.

Advantageously, the indication whether mode 1 or mode 2 is to be applied is included in the encoded audio data and then the mode controller 1600 analyses the encoded data to detect a mode indication. Mode 1 is used when the mode indication indicates that the encoded audio data comprises encoded channels and encoded objects and mode 2 is applied when the mode indication indicates that the encoded audio data does not contain any audio objects, i.e., only contain pre-rendered channels obtained by mode 2 of the FIG. 4 3D audio encoder.

Figure 7:
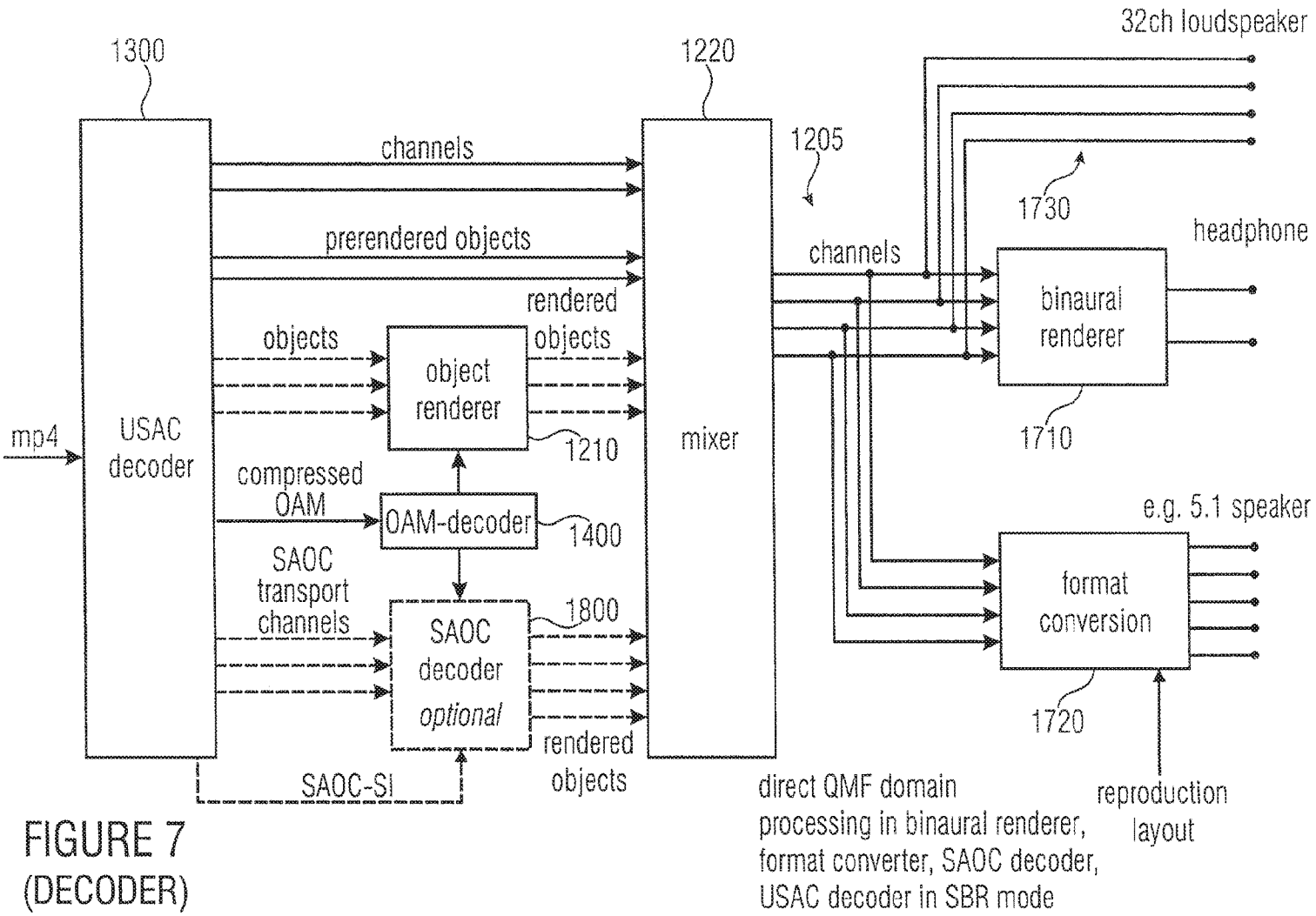
FIG. 7 illustrates a second embodiment of a 3D audio decoder.

FIG. 7 illustrates an advantageous embodiment compared to the FIG. 5 3D audio decoder and the embodiment of FIG. 7 corresponds to the 3D audio encoder of FIG. 6. In addition to the 3D audio decoder implementation of FIG. 5, the 3D audio decoder in FIG. 7 comprises an SAOC decoder 1800. Furthermore, the object processor 1200 of FIG. 5 is implemented as a separate object renderer 1210 and the mixer 1220 while, depending on the mode, the functionality of the object renderer 1210 can also be implemented by the SAOC decoder 1800.

Figure 9:
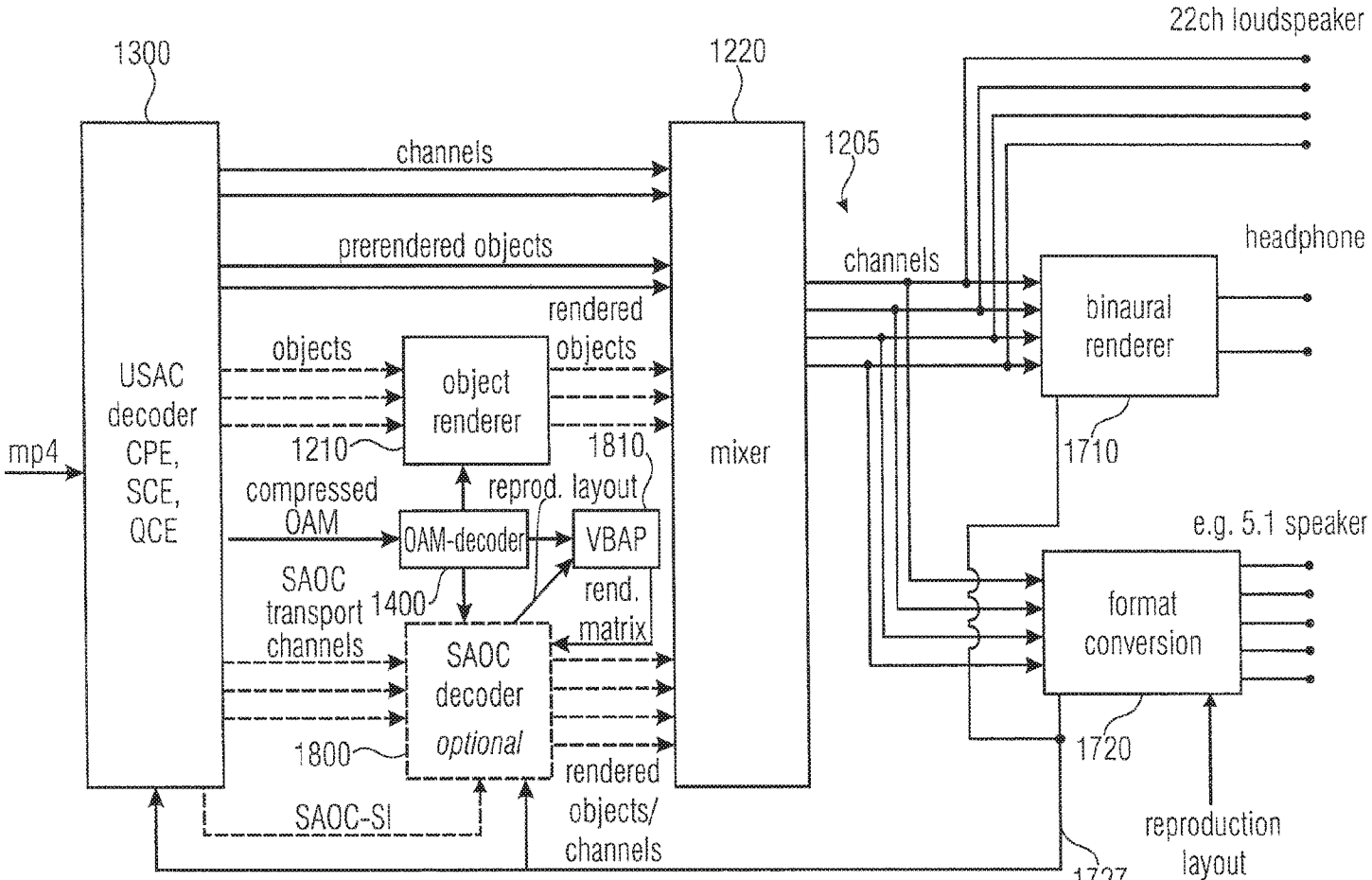
FIG. 9 illustrates a third embodiment of a 3D audio decoder.

Furthermore, the postprocessor 1700 can be implemented as a binaural renderer 1710 or a format converter 1720. Alternatively, a direct output of data 1205 of FIG. 5 can also be implemented as illustrated by 1730. Therefore, it is advantageous to perform the processing in the decoder on the highest number of channels such as 22.2 or 32 in order to have flexibility and to then post-process if a smaller format is useful. However, when it becomes clear from the very beginning that only a different format with smaller number of channels such as a 5.1 format is useful, then it is advantageous, as indicated by FIG. 9 by the shortcut 1727, that a certain control over the SAOC decoder and/or the USAC decoder can be applied in order to avoid unnecessary upmixing operations and subsequent downmixing operations.

In an advantageous embodiment of the present invention, the object processor 1200 comprises the SAOC decoder 1800 and the SAOC decoder is configured for decoding one or more transport channels output by the core decoder and associated parametric data and using decompressed metadata to obtain the plurality of rendered audio objects. To this end, the OAM output is connected to box 1800.

Furthermore, the object processor 1200 is configured to render decoded objects output by the core decoder which are not encoded in SAOC transport channels but which are individually encoded in typically single channeled elements as indicated by the object renderer 1210. Furthermore, the decoder comprises an output interface corresponding to the output 1730 for outputting an output of the mixer to the loudspeakers.

In a further embodiment, the object processor 1200 comprises a spatial audio object coding decoder 1800 for decoding one or more transport channels and associated parametric side information representing encoded audio signals or encoded audio channels, wherein the spatial audio object coding decoder is configured to transcode the associated parametric information and the decompressed metadata into transcoded parametric side information usable for directly rendering the output format, as for example defined in an earlier version of SAOC. The postprocessor 1700 is configured for calculating audio channels of the output format using the decoded transport channels and the transcoded parametric side information. The processing performed by the post processor can be similar to the MPEG Surround processing or can be any other processing such as BCC processing or so.

In a further embodiment, the object processor 1200 comprises a spatial audio object coding decoder 1800 configured to directly upmix and render channel signals for the output format using the decoded (by the core decoder) transport channels and the parametric side information Furthermore, and importantly, the object processor 1200 of FIG. 5 additionally comprises the mixer 1220 which receives, as an input, data output by the USAC decoder 1300 directly when pre-rendered objects mixed with channels exist, i.e., when the mixer 200 of FIG. 4 was active. Additionally, the mixer 1220 receives data from the object renderer performing object rendering without SAOC decoding. Furthermore, the mixer receives SAOC decoder output data, i.e., SAOC rendered objects.

The mixer 1220 is connected to the output interface 1730, the binaural renderer 1710 and the format converter 1720. The binaural renderer 1710 is configured for rendering the output channels into two binaural channels using head related transfer functions or binaural room impulse responses (BRIR). The format converter 1720 is configured for converting the output channels into an output format having a lower number of channels than the output channels 1205 of the mixer and the format converter 1720 may use information on the reproduction layout such as 5.1 speakers or so.

The FIG. 9 3D audio decoder is different from the FIG. 7 3D audio decoder in that the SAOC decoder cannot only generate rendered objects but also rendered channels and this is the case when the FIG. 8 3D audio encoder has been used and the connection 900 between the channels/pre-rendered objects and the SAOC encoder 800 input interface is active.

Furthermore, a vector base amplitude panning (VBAP) stage 1810 is configured which receives, from the SAOC decoder, information on the reproduction layout and which outputs a rendering matrix to the SAOC decoder so that the SAOC decoder can, in the end, provide rendered channels without any further operation of the mixer in the high channel format of 1205, i.e., 32 loudspeakers.

the VBAP block advantageously receives the decoded OAM data to derive the rendering matrices. More general, it advantageously may use geometric information not only of the reproduction layout but also of the positions where the input signals should be rendered to on the reproduction layout. This geometric input data can be OAM data for objects or channel position information for channels that have been transmitted using SAOC.

However, if only a specific output interface may be used then the VBAP state 1810 can already provide the rendering matrix that may be used for the e.g., 5.1 output. The SAOC decoder 1800 then performs a direct rendering from the SAOC transport channels, the associated parametric data and decompressed metadata, a direct rendering into the output format that may be used without any interaction of the mixer 1220. However, when a certain mix between modes is applied, i.e., where several channels are SAOC encoded but not all channels are SAOC encoded or where several objects are SAOC encoded but not all objects are SAOC encoded or when only a certain amount of pre-rendered objects with channels are SAOC decoded and remaining channels are not SAOC processed then the mixer will put together the data from the individual input portions, i.e., directly from the core decoder 1300, from the object renderer 1210 and from the SAOC decoder 1800.

In 3D audio, an azimuth angle, an elevation angle and a radius is used to define the position of an audio object. Moreover, a gain for an audio object may be transmitted.

Azimuth angle, elevation angle and radius unambiguously define the position of an audio object in a 3D space from an origin. This is illustrated with reference to FIG. 10.

Figure 10:
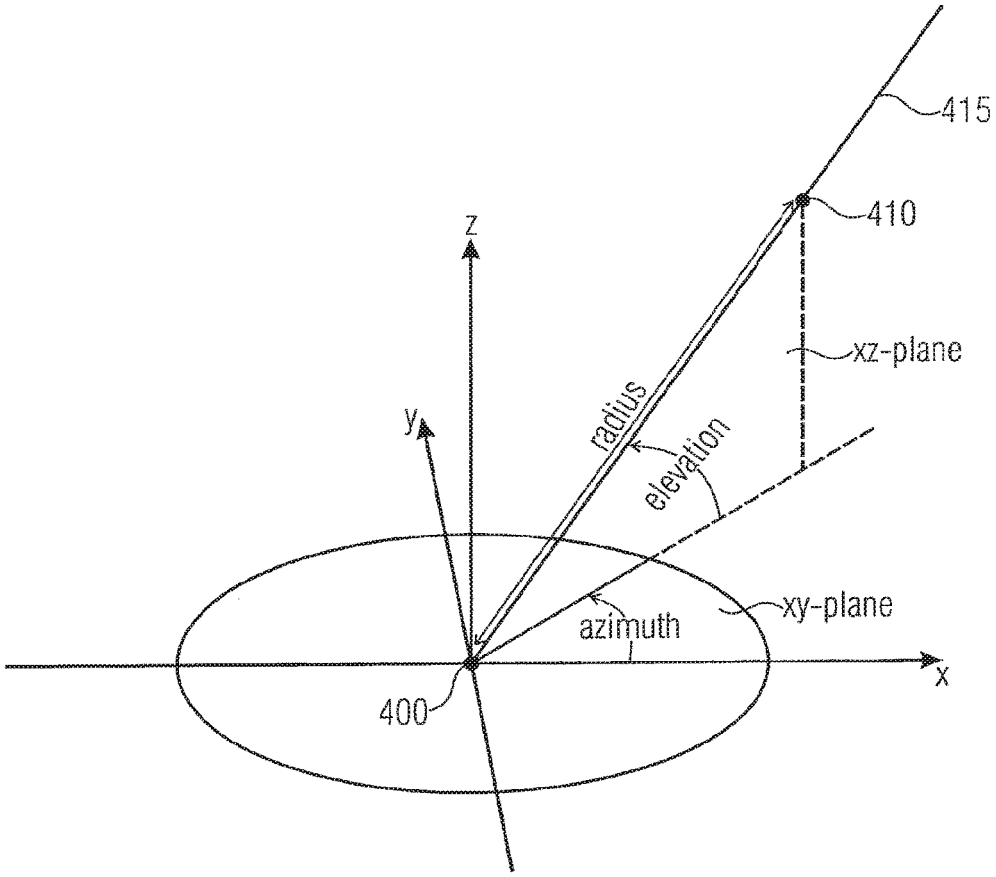
FIG. 10 illustrates the position of an audio object in a three-dimensional space from an origin expressed by azimuth, elevation and radius.

FIG. 10 illustrates the position 410 of an audio object in a three-dimensional (3D) space from an origin 400 expressed by azimuth, elevation and radius.

The azimuth angle specifies, for example, an angle in the xy-plane (the plane defined by the x-axis and the y-axis). The elevation angle defines, for example, an angle in the xz-plane (the plane defined by the x-axis and the z-axis). By specifying the azimuth angle and the elevation angle, the straight line 415 through the origin 400 and the position 410 of the audio object can be defined. By furthermore specifying the radius, the exact position 410 of the audio object can be defined.

In an embodiment, the azimuth angle is defined for the range: $-180° < \text{azimuth} \leq 180°$, the elevation angle is defined for the range: $-90° < \text{elevation} \leq 90°$ and the radius may, for example, be defined in meters [m] (greater than or equal to 0 m). The sphere described by the azimuth, elevation and angle can be divided into two hemispheres: left hemisphere ($0° < \text{azimuth} \leq 180°$) and right hemisphere ($-180° < \text{azimuth} \leq 0°$), or upper hemisphere ($0° < \text{elevation} \leq 90°$) and lower hemisphere ($-90° < \text{elevation} \leq 0°$)

In another embodiment, where it, may, for example, be assumed that all x-values of the audio object positions in an xyz-coordinate system are greater than or equal to zero, the azimuth angle may be defined for the range: $-90° \text{ azimuth} \leq 90°$, the elevation angle may be defined for the range: $-90° < \text{elevation} \leq 90°$, and the radius may, for example, be defined in meters [m].

The downmix processor 120 may, for example, be configured to generate the one or more audio channels depending on the one or more audio object signals depending on the reconstructed metadata information values, wherein the reconstructed metadata information values may, for example, indicate the position of the audio objects.

In an embodiment metadata information values may, for example, indicate, the azimuth angle defined for the range: $-180° < \text{azimuth} \leq 180°$, the elevation angle defined for the range: $-90° < \text{elevation} \leq 90°$ and the radius may, for example, defined in meters [m] (greater than or equal to 0 m).

Figure 11:
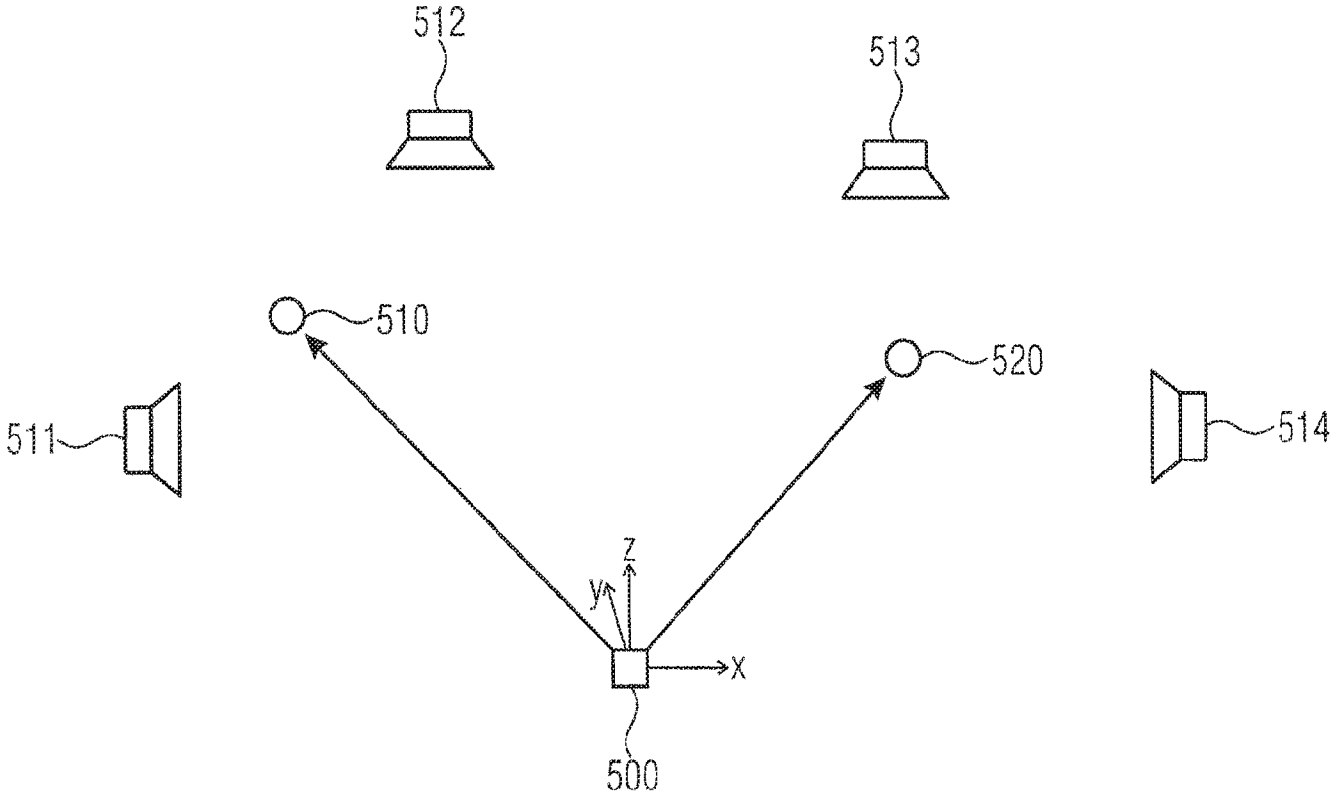
FIG. 11 illustrates positions of audio objects and a loudspeaker setup assumed by the audio channel generator.

FIG. 11 illustrates positions of audio objects and a loudspeaker setup assumed by the audio channel generator. The origin 500 of the xyz-coordinate system is illustrated. Moreover, the position 510 of a first audio object and the position 520 of a second audio object is illustrated. Furthermore, FIG. 11 illustrates a scenario, where the audio channel generator 120 generates four audio channels for four loudspeakers. The audio channel generator 120 assumes that the four loudspeakers 511, 512, 513 and 514 are located at the positions shown in FIG. 11.

In FIG. 11, the first audio object is located at a position 510 close to the assumed positions of loudspeakers 511 and 512, and is located far away from loudspeakers 513 and 514. Therefore, the audio channel generator 120 may generate the four audio channels such that the first audio object 510 is reproduced by loudspeakers 511 and 512 but not by loudspeakers 513 and 514.

In other embodiments, audio channel generator 120 may generate the four audio channels such that the first audio object 510 is reproduced with a high level by loudspeakers 511 and 512 and with a low level by loudspeakers 513 and 514.

Moreover, the second audio object is located at a position 520 close to the assumed positions of loudspeakers 513 and 514, and is located far away from loudspeakers 511 and 512. Therefore, the audio channel generator 120 may generate the four audio channels such that the second audio object 520 is reproduced by loudspeakers 513 and 514 but not by loudspeakers 511 and 512.

In other embodiments, downmix processor 120 may generate the four audio channels such that the second audio object 520 is reproduced with a high level by loudspeakers 513 and 514 and with a low level by loudspeakers 511 and 512.

In alternative embodiments, only two metadata information values are used to specify the position of an audio object. For example, only the azimuth and the radius may be specified, for example, when it is assumed that all audio objects are located within a single plane.

In further other embodiments, for each audio object, only a single metadata information value of a metadata signal is encoded and transmitted as position information. For example, only an azimuth angle may be specified as position information for an audio object (e.g., it may be assumed that all audio objects are located in the same plane having the same distance from a center point, and are thus assumed to have the same radius). The azimuth information may, for example, be sufficient to determine that an audio object is located close to a left loudspeaker and far away from a right loudspeaker. In such a situation, the audio channel generator 120 may, for example, generate the one or more audio channels such that the audio object is reproduced by the left loudspeaker, but not by the right loudspeaker.

For example, Vector Base Amplitude Panning may be employed to determine the weight of an audio object signal within each of the audio output channels (see, e.g., [VBAP]). With respect to VBAP, it is assumed that an audio object signal is assigned to a virtual source, and it is furthermore assumed that an audio output channel is a channel of a loudspeaker.

In embodiments, a further metadata information value e.g., of a further metadata signal may specify a volume, e.g., a gain (for example, expressed in decibel [dB]) for each audio object.

For example, in FIG. 11, a first gain value may be specified by a further metadata information value for the first audio object located at position 510 which is higher than a second gain value being specified by another further metadata information value for the second audio object located at position 520. In such a situation, the loudspeakers 511 and 512 may reproduce the first audio object with a level being higher than the level with which loudspeakers 513 and 514 reproduce the second audio object.

According to SAOC technique, an SAOC encoder receives a plurality of audio object signals X and downmixes them by employing a downmix matrix D to obtain an audio transport signal Y comprising one or more audio transport channels. The formula $$Y=DX$$

may be employed. The SAOC encoder transmits the audio transport signal Y and information on the downmix matrix D (e.g., coefficients of the downmix matrix D) to the SAOC decoder. Moreover, the SAOC encoder transmits information on a covariance matrix E (e.g., coefficients of the covariance matrix E) to the SAOC decoder.

On the decoder side, the audio object signals X could be reconstructed to obtain reconstructed audio objects $\hat{X}$ by employing the formula $$\hat{X}=GY$$

wherein G is a parametric source estimation matrix with $G=E\,D^H\,(D\,E\,D^H)^{-1}$.

Then, one or more audio output channels Z could be generated by applying a rendering matrix R on the reconstructed audio objects $\hat{X}$ according to the formula:

$$Z=R\hat{X}.$$

Generating the one or more audio output channels Z from the audio transport signal can, however, be also conducted in a single step by employing matrix U according to the formula:

$$Z=UY, \text{ with } U=RG.$$

Each row of the rendering matrix R is associated with one of the audio output channels that shall be generated. Each coefficient within one of the rows of the rendering matrix R determines the weight of one of the reconstructed audio object signals within the audio output channel, to which said row of the rendering matrix R relates.

For example, the rendering matrix R may depend on position information for each of the audio object signals transmitted to the SAOC decoder within metadata information. For example, an audio object signal having a position that is located close to an assumed or real loudspeaker position may, e.g., have a higher weight within the audio output channel of said loudspeaker than the weight of an audio object signal, the position of which is located far away from said loudspeaker (see FIG. 5). For example, Vector Base Amplitude Panning may be employed to determine the weight of an audio object signal within each of the audio output channels (see, e.g., [VBAP]). With respect to VBAP, it is assumed that an audio object signal is assigned to a virtual source, and it is furthermore assumed that an audio output channel is a channel of a loudspeaker.

In FIGS. 6 and 8, a SAOC encoder 800 is depicted. The SAOC encoder 800 is used to parametrically encode a number of input objects/channels by downmixing them to a lower number of transport channels and extracting the auxiliary information that may be used which is embedded into the 3D-Audio bitstream.

The downmixing to a lower number of transport channels is done using downmixing coefficients for each input signal and downmix channel (e.g., by employing a downmix matrix).

The state of the art in processing audio object signals is the MPEG SAOC-system. One main property of such a system is that the intermediate downmix signals (or SAOC Transport Channels according to FIGS. 6 and 8) can be listened with legacy devices incapable of decoding the SAOC information. This imposes restrictions on the downmix coefficients to be used, which usually are provided by the content creator.

The 3D Audio Codec System has the purpose to use SAOC technology to increase the efficiency for coding a large number of objects or channels. Downmixing a large number of objects to a small number of transport channels saves bitrate.

Figure 2:
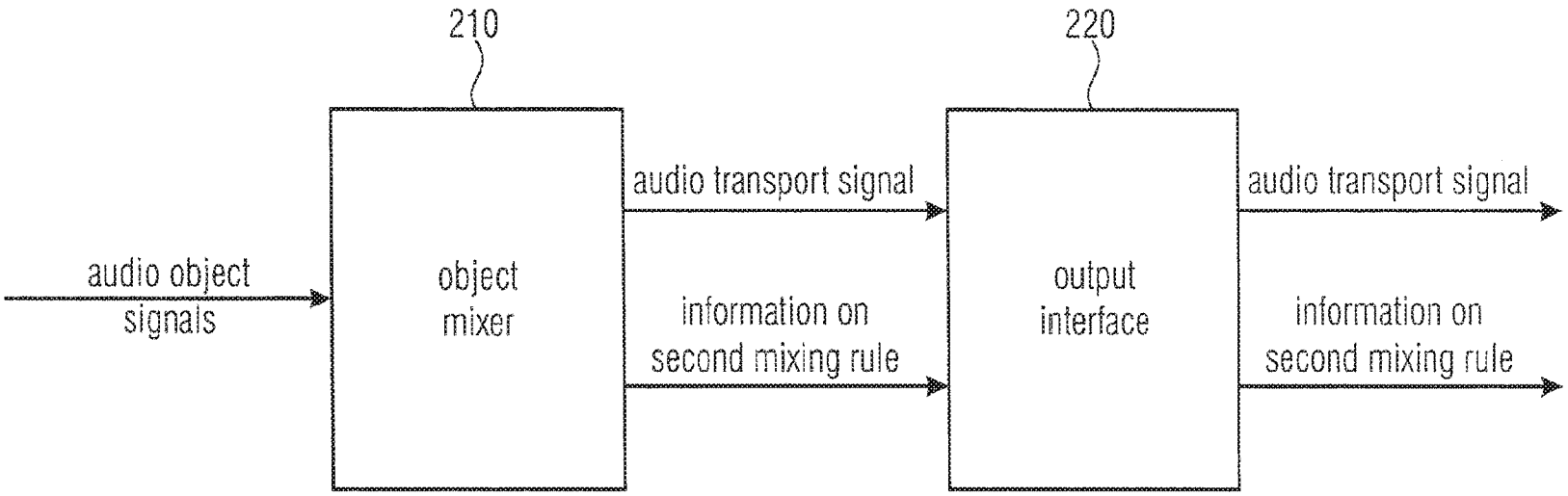
FIG. 2 illustrates an apparatus for generating an audio transport signal comprising one or more audio transport channels according to an embodiment.

FIG. 2 illustrates an apparatus for generating an audio transport signal comprising one or more audio transport channels according to an embodiment.

The apparatus comprises an object mixer 210 for generating the audio transport signal comprising the one or more audio transport channels from two or more audio object signals, such that the two or more audio object signals are mixed within the audio transport signal, and wherein the number of the one or more audio transport channels is smaller than the number of the two or more audio object signals.

Moreover, the apparatus comprises an output interface 220 for outputting the audio transport signal.

The object mixer 210 is configured to generate the one or more audio transport channels of the audio transport signal depending on a first mixing rule and depending on a second mixing rule, wherein the first mixing rule indicates how to mix the two or more audio object signals to obtain a plurality of premixed channels, and wherein the second mixing rule indicates how to mix the plurality of premixed channels to obtain the one or more audio transport channels of the audio transport signal. The first mixing rule depends on an audio objects number, indicating the number of the two or more audio object signals, and depends on a premixed channels number, indicating the number of the plurality of premixed channels, and wherein the second mixing rule depends on the premixed channels number. The output interface 220 is configured to output information on the second mixing rule.

Figure 1:
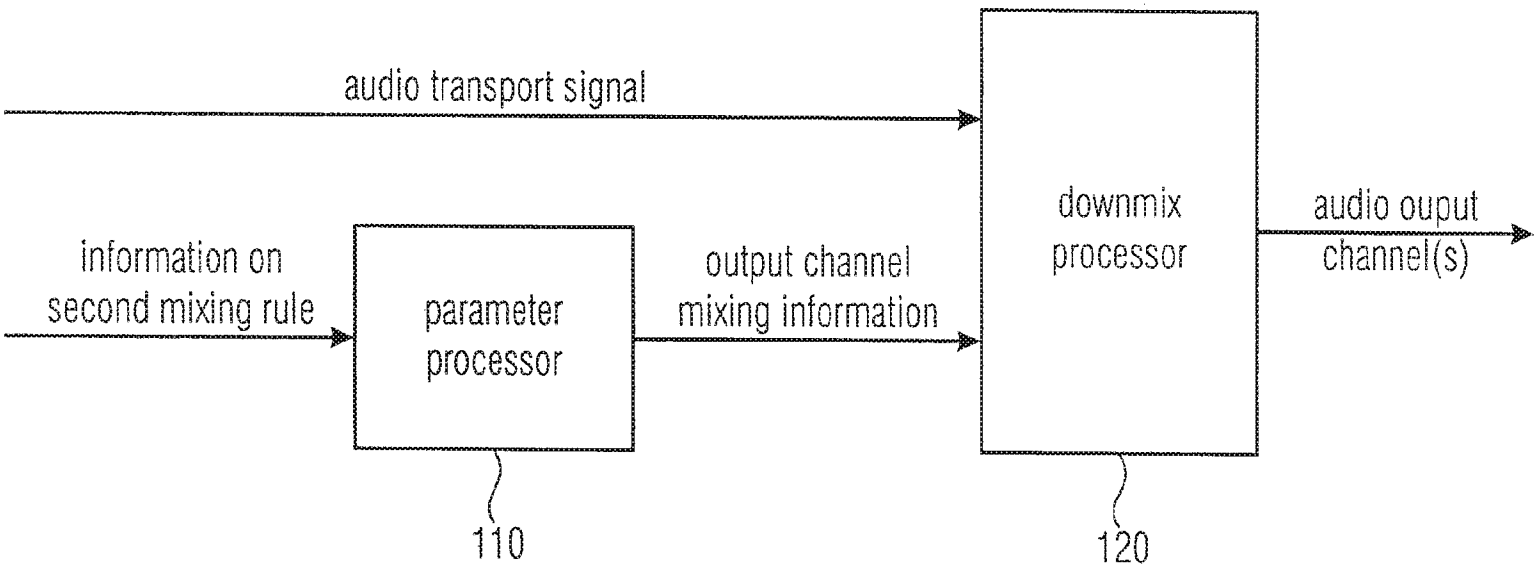
FIG. 1 illustrates an apparatus for generating one or more audio output channels according to an embodiment.

FIG. 1 illustrates an apparatus for generating one or more audio output channels according to an embodiment.

The apparatus comprises a parameter processor 110 for calculating output channel mixing information and a downmix processor 120 for generating the one or more audio output channels.

The downmix processor 120 is configured to receive an audio transport signal comprising one or more audio transport channels, wherein two or more audio object signals are mixed within the audio transport signal, and wherein the number of the one or more audio transport channels is smaller than the number of the two or more audio object signals. The audio transport signal depends on a first mixing rule and on a second mixing rule. The first mixing rule indicates how to mix the two or more audio object signals to obtain a plurality of premixed channels. Moreover, the second mixing rule indicates how to mix the plurality of premixed channels to obtain the one or more audio transport channels of the audio transport signal.

The parameter processor 110 is configured to receive information on the second mixing rule, wherein the information on the second mixing rule indicates how to mix the plurality of premixed signals such that the one or more audio transport channels are obtained. The parameter processor 110 is configured to calculate the output channel mixing information depending on an audio objects number indicating the number of the two or more audio object signals, depending on a premixed channels number indicating the number of the plurality of premixed channels, and depending on the information on the second mixing rule.

The downmix processor 120 is configured to generate the one or more audio output channels from the audio transport signal depending on the output channel mixing information.

According to an embodiment, the apparatus may, e.g., be configured to receive at least one of the audio objects number and the premixed channels number.

In another embodiment, the parameter processor 110 may, e.g., be configured to determine, depending on the audio objects number and depending on the premixed channels number, information on the first mixing rule, such that the information on the first mixing rule indicates how to mix the two or more audio object signals to obtain the plurality of premixed channels. In such an embodiment, the parameter processor 110 may, e.g., be configured to calculate the output channel mixing information, depending on the information on the first mixing rule and depending on the information on the second mixing rule.

According to an embodiment, the parameter processor 110 may, e.g., be configured to determine, depending on the audio objects number and depending on the premixed channels number, a plurality of coefficients of a first matrix P as the information on the first mixing rule, wherein the first matrix P indicates how to mix the plurality of premixed channels to obtain the one or more audio transport channels of the audio transport signal. In such an embodiment, the parameter processor 110, may, e.g., be configured to receive a plurality of coefficients of a second matrix P as the information on the second mixing rule, wherein the second matrix Q indicates how to mix the plurality of premixed channels to obtain the one or more audio transport channels of the audio transport signal. The parameter processor 110 of such an embodiment may, e.g., configured to calculate the output channel mixing information depending on the first matrix P and depending on the second matrix Q.

Embodiments are based on the finding that when downmixing the two or more audio object signals X to obtain an audio transport signal Y on the encoder side by employing downmix matrix D according to the formula $$Y=DX,$$

then downmix matrix D can be divided into the two smaller matrices P and Q according to the formula $$D=QP.$$

Here, the first matrix P realizes the mix from the audio object signals X to the plurality of premixed channels $X_{pre}$ according to the formula:

$$X_{pre}=PX.$$

The second matrix Q realizes the mix from the plurality of premix channels $X_{pre}$ to the one or more audio transport channels of the audio transport signal Y according to the formula:

$$Y=Q\,X_{pre}.$$

According to embodiments, information on the second mixing rule, e.g., on the coefficients of the second mixing matrix Q, is transmitted to the decoder.

The coefficients of the first mixing matrix P do not have to be transmitted to the decoder. Instead, the decoder receives information on the number of audio object signals and information on the number of premixed channels. From this information, the decoder is capable of reconstructing the first mixing matrix P. For example, the encoder and decoder determine the mixing matrix P in the same way, when mixing a first number of $N_{objects}$ audio object signals to a second number $N_{pre}$ premixed channels.

FIG. 3 illustrates a system according to an embodiment. The system comprises an apparatus 310 for generating an audio transport signal as described above with reference to FIG. 2 and an apparatus 320 for generating one or more audio output channels as described above with reference to FIG. 1.

The apparatus 320 for generating one or more audio output channels is configured to receive the audio transport signal and information on the second mixing rule from the apparatus 310 for generating an audio transport signal. Moreover, the apparatus 320 for generating one or more audio output channels is configured to generate the one or more audio output channels from the audio transport signal depending on the information on the second mixing rule.

For example, the parameter processor 110 may, e.g., be configured to receive metadata information comprising position information for each of the two or more audio object signals, and determines the information on the first downmix rule depending on the position information of each of the two or more audio object signals, e.g., by employing Vertical Base Amplitude Panning. E.g., the encoder may also have access to the position information of each of the two or more audio object signals and may also employ Vector Base Amplitude Panning to determining the weights of the audio object signals in the premixed channels, and by this determines the coefficients of the first matrix P in the same way as done later by the decoder (e.g., both encoder and decoder may assume the same positioning of the assumed loudspeakers assigned to the $N_{pre}$ premixed channels).

By receiving the coefficients of the second matrix Q and by determining the first matrix P, the decoder can determine the downmix matrix D according to D=QP.

In an embodiment, the parameter processor 110 may, for example, be configured to receive covariance information, e.g., coefficients of a covariance matrix E (e.g., from the apparatus for generating the audio transport signal), indicating an object level difference for each of the two or more audio object signals, and, possibly, indicating one or more inter object correlations between one of the audio object signals and another one of the audio object signals.

In such an embodiment, the parameter processor 110 may be configured to calculate the output channel mixing information depending on the audio objects number, depending on the premixed channels number, depending on the information on the second mixing rule, and depending on the covariance information.

For example, using the covariance matrix E, the audio object signals X could be reconstructed to obtain reconstructed audio objects $\hat{X}$ by employing the formula $$\hat{X}=GY$$

wherein G is a parametric source estimation matrix with $G=E\,D^H\,(D\,E\,D^H)^{-1}$.

Then, one or more audio output channels Z could be generated by applying a rendering matrix R on the reconstructed audio objects $\hat{X}$ according to the formula:

$$Z=R\hat{X}.$$

Generating the one or more audio output channels Z from the audio transport signal can, however, be also conducted in a single step by employing matrix U according to the formula:

$$Z=UY, \text{ with } S=UG.$$

Such a matrix S is an example for an output channel mixing information determined by the parameter processor 110.

For example, as already explained above, each row of the rendering matrix R may be associated with one of the audio output channels that shall be generated. Each coefficient within one of the rows of the rendering matrix R determines the weight of one of the reconstructed audio object signals within the audio output channel, to which said row of the rendering matrix R relates.

According to an embodiment, wherein the parameter processor 110 may, e.g., be configured to receive metadata information comprising position information for each of the two or more audio object signals, may e.g., be configured to determine rendering information, e.g., the coefficients of the rendering matrix R depending on the position information of each of the two or more audio object signals, and may, e.g., be configured to calculate the output channel mixing information (e.g., the above matrix S) depending on the audio objects number, depending on the premixed channels number, depending on the information on the second mixing rule, and depending on the rendering information (e.g., rendering matrix R).

Thus, the rendering matrix R may, for example, depend on position information for each of the audio object signals transmitted to the SAOC decoder within metadata information. E.g., an audio object signal having a position that is located close to an assumed or real loudspeaker position may, e.g., have a higher weight within the audio output channel of said loudspeaker than the weight of an audio object signal, the position of which is located far away from said loudspeaker (see FIG. 5). For example, Vector Base Amplitude panning may be employed to determine the weight of an audio object signal within each of the audio output channels (see, e.g., [VBAP]). With respect to VBAP, it is assumed that an audio object signal is assigned to a virtual source, and it is furthermore assumed that an audio output channel is a channel of a loudspeaker. The corresponding coefficient of the rendering matrix R (the coefficient that is assigned to the considered audio output channel and the considered audio object signal) may then be set to value depending on such a weight. For example, the weight itself may be the value of said corresponding coefficient within the rendering matrix R.

In the following, embodiments realizing spatial downmix for object based signals are explained in detail.

Reference is made to the following notations and definitions:

$N_{Objects}$ number of input audio object signals $N_{Channels}$ number of input channels N number of input signals;

N can be equal with $N_{objects}$, $N_{Channels}$ or $N_{objects}+N_{Channels}$ $N_{DmxCh}$ number of downmix (processed) channels $N_{pre}$ number of premix channels $N_{Samples}$ number of processed data samples D downmix matrix, size $N_{DmxCh}\times N$ X input audio signal comprising the two or more audio input signals, size $N\times N_{Samples}$ Y downmix audio signal (the audio transport signal), size $N_{DmxCh}\times N_{Samples}$, defined as Y=DX DMG downmix gain data for every input signal, downmix channel, and parameter set $D_{DMG}$ is the three dimensional matrix holding the dequantized, and mapped DMG data for every input signal, downmix channel, and parameter set Without loss of generality, in order to improve readability of equations, for all introduced variables the indices denoting time and frequency dependency are omitted.

If no constrain is specified regarding the input signals (channels or objects), the downmix coefficients are computed in the same way for input channel signals and input object signals. The notation for the number of input signals N is used.

Some embodiments may, e.g., be designed for downmixing the object signals in a different manner than the channel signals, guided by the spatial information available in the object metadata.

The downmix may be separated in two steps:

In a first step, the objects are prerendered to the reproduction layout with the highest number of loudspeakers $N_{pre}$ (e.g., $N_{pre}=22$ given by the 22.2 configuration). E.g., the first matrix P may be employed.

In a second step, the obtained $N_{pre}$ prerendered signals are downmixed to the number of available transport channels ($N_{DmxCh}$) (e.g., according to an orthogonal downmix distribution algorithm). E.g., the second matrix Q may be employed.

However, in some embodiments, the downmix is done in a single step, e.g., by employing matrix D defined according to the formula: D=QP, and by applying Y=DX with D=QP.

Inter alia, a further advantage of the proposed concepts is, e.g., that the input object signals which are supposed to be rendered at the same spatial position, in the audio scene, are downmixed together in same transport channels. Consequently at the decoder side a better separation of the prerendered signals is obtained, avoiding separation of audio objects which will be mixed back together in the final reproduction scene.

According to particular advantageous embodiments, the downmix can be described as a matrix multiplication by:

$$X_{pre}=PX \text{ and } Y=QX_{pre}.$$

where P of size ($N_{pre}\times N_{Objects}$) and Q of size ($N_{DmxCh}\times N_{pre}$) are computed as explained in the following.

The mixing coefficients in P are constructed from the object signals metadata (radius, gain, azimuth and elevation angles) using a panning algorithm (e.g. Vector Base Amplitude Panning). The panning algorithm should be the same with the one used at the decoder side for constructing the output channels.

The mixing coefficients in Q are given at the encoder side for $N_{pre}$ input signals and $N_{DmxCh}$ available transport channels.

In order to reduce the computational complexity, the two-step downmix can be simplified to one by computing the final downmix gains as:

$$D=QP.$$

Then the downmix signals are given by:

$$Y=DX.$$

The mixing coefficients in P are not transmitted within the bitstream. Instead, they are reconstructed at the decoder side using the same panning algorithm. Therefore the bitrate is reduced by sending only the mixing coefficients in Q. In particular, as the mixing coefficients in P are usually time variant, and as P is not transmitted, a high bitrate reduction can be achieved.

In the following, the bitstream syntax according to an embodiment is considered.

For signaling the used downmix method and the number of channels $N_{pre}$ to prerender the objects in the first step, the MPEG SAOC bitstream syntax is extended with 4 bits:

| bsSaocDmxMethod | Mode | Meaning |
|---|---|---|
| 0 | Direct mode | Downmix matrix is constructed directly from the dequantized DMGs (downmix gains). |
| 1, . . . , 15 | Pre-mixing mode | Downmix matrix is constructed as a product of the matrix obtained from the dequantized DMGs and a premixing matrix obtained from the spatial information of the input audio objects. |

bsNumPremixedChannels

| bsSaocDmxMethod | bsNumPremixedChannels |
|---|---|
| 0 | 0 |
| 1 | 22 |
| 2 | 11 |
| 3 | 10 |
| 4 | 8 |
| 5 | 7 |
| 6 | 5 |
| 7 | 2 |
| 8, . . . , 14 | reserved |
| 15 | escape value |

In context of MPEG SAOC, this can be accomplished by the following modification:

bsSaocDmxMethod: Indicates how the downmix matrix is constructed

Syntax of SAOC3DSpecificConfig( )—Signaling

```
bsSaocDmxMethod;                    4    uimsbf
if (bsSaocDmxMethod == 15) {
    bsNumPremixedChannels;          5    uimsbf
}
```

Syntax of Saoc3DFrame( ): the way that DMGs are read for different modes

```
if (bsNumSaocDmxObjects==0) {
    for( i=0; i< bsNumSaocDmxChannels; i++ ) {
        idxDMG[i] = EcDataSaoc(DMG, 0, NumInputSignals);
    }
} else {
    dmgIdx = 0;
    for( i=0; i<bsNumSaocDmxChannels; i++ ) {
        idxDMG[i] = EcDataSaoc(DMG, 0, bsNumSaocChannels);
    }
    dmgIdx = bsNumSaocDmxChannels;
    if (bsSaocDmxMethod == 0) {
        for( i=dmgIdx; i<dmgIdx + bsNumSaocDmxObjects; i++ ) {
            idxDMG[i] = EcDataSaoc(DMG, 0, bsNumSaocObjects);
        }
    } else {
        for( i= dmgIdx; i<dmgIdx + bsNumSaocDmxObjects; i++ ) {
            idxDMG[i] = EcDataSaoc(DMG, 0, bsNumPremixedChannels);
        }
    }
}
```

| | |
|---|---|
| bsNumSaocDmxChannels | Defines the number of downmix channels for channels based content. If no channels are present in the downmix bsNumSaocDmxChannels is set to zero. |
| bsNumSaocChannels | Defines the number of input channels for which SAOC3D parameters are transmitted. If bsNumSaocChannels = 0 no channels are present in the downmix. |
| bsNumSaocDmxObjects | Defines the number of downmix channels for object based content. If no objects are present in the downmix bsNumSaocDmxObjects is set to zero. |
| bsNumPremixedChannels | Defines the number of premixing channels for the input audio objects. If bsSaocDmxMethod equals 15 then the actual number of premixed channels is signaled directly by the value of bsNumPremixedChannels. In all other cases bsNumPremixedChannels is set according to the previous table. |

According to an embodiment, the downmix matrix D applied to the input audio signals S determines the downmix signal as $$X=DS.$$

The downmix matrix D of size $N_{dmx}\times N$ is obtained as:

$$D=D_{dmx}D_{premix}.$$

The matrix $D_{dmx}$ and matrix $D_{premix}$ have different sizes depending on the processing mode.

The matrix $D_{dmx}$ is obtained from the DMG parameters as:

$$d_{i,j}=\begin{cases}0, & \text{if no } DMG \text{ data for pair } (i,j) \text{ is present in the bitstream}\\ 10^{0.05DMG_{i,j}}, & \text{otherwise}\end{cases}.$$

Here, the dequantized downmix parameters are obtained as:

$$DMG_{i,j}=D_{DMG}(i,j,l).$$

In case of direct mode, no premixing is used. The matrix $D_{premix}$ has size N×N and is given by: $D_{premix}=I$. The matrix $D_{dmx}$ has size $N_{dmx}\times N$ and is obtained from the DMG parameters.

In case of premixing mode the matrix $D_{premix}$ has size $(N_{ch}+N_{premix})\times N$ and is given by:

$$D_{premix} = \begin{pmatrix} I & 0 \\ 0 & A \end{pmatrix},$$

where the premixing matrix A of size $N_{premix}$ is received as an input to the SAOC 3D decoder, from the object renderer.

The matrix $D_{dmx}$ has size $N_{dmx}\times(N_{ch}+N_{premix}$ and is obtained from the DMG parameters.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[SAOC1] J. Herre, S. Disch, J. Hilpert, O. Hellmuth: "From SAC To SAOC—Recent Developments in Parametric Coding of Spatial Audio", 22nd Regional UK AES Conference, Cambridge, UK, April 2007.

[SAOC2] J. Engdeård, B. Resch, C. Falch, O. Hellmuth, J. Hilpert, A. Hölzer, L. Terentiev, J. Breebaart, J. Koppens, E. Schuijers and W. Oomen: "Spatial Audio Object Coding (SAOC)—The Upcoming MPEG Standard on Parametric Object Based Audio Coding", 124th AES Convention, Amsterdam 2008.

[SAOC] ISO/IEC, "MPEG audio technologies—Part 2: Spatial Audio Object Coding (SAOC)," ISO/IEC JTC1/SC29/WG11 (MPEG) International Standard 23003-2.

[VBAP] Ville Pulkki, "Virtual Sound Source Positioning Using Vector Base Amplitude Panning"; J. Audio Eng. Soc., Level 45, Issue 6, pp. 456-466, June 1997.

[M1] Peters, N., Lossius, T. and Schacher J. C., "SpatDIF: Principles, Specification, and Examples", 9th Sound and Music Computing Conference, Copenhagen, Denmark, July 2012.

[M2] Wright, M., Freed, A., "Open Sound Control: A New Protocol for Communicating with Sound Synthesizers", International Computer Music Conference, Thessaloniki, Greece, 1997.

[M3] Matthias Geier, Jens Ahrens, and Sascha Spors. (2010), "Object-based audio reproduction and the audio scene description format", Org. Sound, Vol. 15, No. 3, pp. 219-227, December 2010.

[M4] W3C, "Synchronized Multimedia Integration Language (SMIL 3.0)", December 2008.

[M5] W3C, "Extensible Markup Language (XML) 1.0 (Fifth Edition)", November 2008.

[M6] MPEG, "ISO/IEC International Standard 14496-3-Coding of audio-visual objects, Part 3 Audio", 2009.

[M7] Schmidt, J.; Schroeder, E. F. (2004), "New and Advanced Features for Audio Presentation in the MPEG-4 Standard", 116th AES Convention, Berlin, Germany, May 2004.

[M8] Web3D, "International Standard ISO/IEC 14772-1: 1997—The Virtual Reality Modeling Language (VRML), Part 1: Functional specification and UTF-8 encoding", 1997.

[M9] Sporer, T. (2012), "Codierung räumlicher Audiosignale mit leichtgewichtigen Audio-Objekten", Proc.

Annual Meeting of the German Audiological Society (DGA), Erlangen, Germany, March 2012.

The invention claimed is:

1. An apparatus for generating one or more audio output channels, wherein the apparatus comprises:

a downmix processor for generating the one or more audio output channels, wherein the downmix processor is configured to receive an audio transport signal comprising one or more audio transport channels, wherein two or more audio object signals are mixed within the audio transport signal, and wherein the number of the one or more audio transport channels is smaller than the number of the two or more audio object signals, wherein the audio transport signal depends on a first mixing rule and on a second mixing rule, wherein the first mixing rule indicates how to mix the two or more audio object signals to obtain a plurality of premixed channels, and wherein the second mixing rule indicates how to mix the plurality of premixed channels to obtain the one or more audio transport channels of the audio transport signal, and wherein the downmix processor is configured to generate the one or more audio output channels from the audio transport signal depending on output channel mixing information, wherein the output channel mixing information depends on an audio objects number indicating the number of the two or more audio object signals and depends on a premixed channels number indicating the number of the plurality of premixed channels and depends on the information on the second mixing rule.

2. An apparatus according to claim 1, wherein the apparatus is configured to receive at least one of the audio objects number and the premixed channels number.

3. An apparatus according to claim 1, wherein the apparatus further comprises a parameter processor for calculating output channel mixing information, wherein the parameter processor is configured to receive information on the second mixing rule, wherein the information on the second mixing rule indicates how to mix the plurality of premixed signals such that the one or more audio transport channels are obtained, wherein the parameter processor is configured to calculate the output channel mixing information depending on the audio objects number indicating the number of the two or more audio object signals, depending on the premixed channels number indicating the number of the plurality of premixed channels, and depending on the information on the second mixing rule, wherein the parameter processor is configured to determine, depending on the audio objects number and depending on the premixed channels number, information on the first mixing rule, such that the information on the first mixing rule indicates how to mix the two or more audio object signals to obtain the plurality of premixed channels, and wherein the parameter processor is configured to calculate the output channel mixing information, depending on the information on the first mixing rule and depending on the information on the second mixing rule.

4. An apparatus according to claim 3, wherein the parameter processor is configured to determine, depending on the audio objects number and depending on the premixed channels number, a plurality of coefficients of a first matrix (P) as the information on the first mixing rule, wherein the first matrix (P) indicates how to mix the plurality of premixed channels to obtain the one or more audio transport channels of the audio transport signal, wherein the parameter processor is configured to receive a plurality of coefficients of a second matrix (Q) as the information on the second mixing rule, wherein the second matrix (Q) indicates how to mix the plurality of premixed channels to obtain the one or more audio transport channels of the audio transport signal, and wherein the parameter processor is configured to calculate the output channel mixing information depending on the first matrix (P) and depending on the second matrix (Q).

5. An apparatus according to claim 3, wherein the parameter processor is configured to receive metadata information comprising position information for each of the two or more audio object signals, wherein the parameter processor is configured to determine the information on the first downmix rule depending on the position information of each of the two or more audio object signals.

6. An apparatus according to claim 5, wherein the parameter processor is configured to determine rendering information depending on the position information of each of the two or more audio object signals, and wherein the parameter processor is configured to calculate the output channel mixing information depending on the audio objects number, depending on the premixed channels number, depending on the information on the second mixing rule, and depending on the rendering information.

7. An apparatus according to claim 3, wherein the parameter processor is configured to receive covariance information indicating an object level difference for each of the two or more audio object signals, and wherein the parameter processor is configured to calculate the output channel mixing information depending on the audio objects number, depending on the premixed channels number, depending on the information on the second mixing rule, and depending on the covariance information.

8. An apparatus according to claim 7, wherein the covariance information further indicates at least one inter object correlation between one of the two or more audio object signals and another one of the two or more audio object signals, and wherein the parameter processor is configured to calculate the output channel mixing information depending on the audio objects number, depending on the premixed channels number, depending on the information on the second mixing rule, depending on the object level difference of each of the two or more audio object signals and depending on the at least one inter object correlation between one of the two or more audio object signals and another one of the two or more audio object signals.

9. An apparatus for generating an audio transport signal comprising one or more audio transport channels, wherein the apparatus comprises:

an object mixer for generating the audio transport signal comprising the one or more audio transport channels from two or more audio object signals, such that the two or more audio object signals are mixed within the audio transport signal, and wherein the number of the one or more audio transport channels is smaller than the number of the two or more audio object signals, and an output interface for outputting the audio transport signal, wherein the object mixer is configured to generate the one or more audio transport channels of the audio transport signal depending on a first mixing rule and depending on a second mixing rule, wherein the first mixing rule indicates how to mix the two or more audio object signals to obtain a plurality of premixed channels, and wherein the second mixing rule indicates how to mix the plurality of premixed channels to obtain the one or more audio transport channels of the audio transport signal, and wherein the output interface is configured to output information on the second mixing rule, wherein the output interface is configured to output information on an audio objects number indicating the number of the two or more audio object signals, and wherein the output interface is configured to output information on a premixed channels number indicating the number of the plurality of premixed channels.

10. An apparatus according to claim 9, wherein the first mixing rule depends on an audio objects number, indicating the number of the two or more audio object signals, and depends on a premixed channels number, indicating the number of the plurality of premixed channels, and wherein the second mixing rule depends on the premixed channels number, wherein object mixer is configured to generate the one or more audio transport channels of the audio transport signal depending on a first matrix (P), wherein the first matrix (P) indicates how to mix the plurality of premixed channels to obtain the one or more audio transport channels of the audio transport signal, and depending on a second matrix (Q), wherein the second matrix (Q) indicates how to mix the plurality of premixed channels to obtain the one or more audio transport channels of the audio transport signal, and wherein the parameter processor is configured to output a plurality of coefficients of the second matrix (Q) as the information on the second mixing rule.

11. An apparatus according to claim 9, wherein the first mixing rule depends on an audio objects number, indicating the number of the two or more audio object signals, and depends on a premixed channels number, indicating the number of the plurality of premixed channels, and wherein the second mixing rule depends on the premixed channels number, wherein the object mixer is configured to receive position information for each of the two or more audio object signals, and wherein the object mixer is configured to determine the first mixing rule depending on the position information of each of the two or more audio object signals.

12. A system, comprising:

an apparatus for generating an audio transport signal comprising one or more audio transport channels, and an apparatus according to claim 1 for generating one or more audio output channels, wherein the apparatus for generating the audio transport signal comprises:

an object mixer for generating the audio transport signal comprising the one or more audio transport channels from two or more audio object signals, such that the two or more audio object signals are mixed within the audio transport signal, and wherein the number of the one or more audio transport channels is smaller than the number of the two or more audio object signals, and an output interface for outputting the audio transport signal, wherein the object mixer is configured to generate the one or more audio transport channels of the audio transport signal depending on a first mixing rule and depending on a second mixing rule, wherein the first mixing rule indicates how to mix the two or more audio object signals to obtain a plurality of premixed channels, and wherein the second mixing rule indicates how to mix the plurality of premixed channels to obtain the one or more audio transport channels of the audio transport signal, and wherein the output interface is configured to output information on the second mixing rule, wherein the apparatus according to claim 1 is configured to receive the audio transport signal and information on the second mixing rule from the apparatus for generating the audio transport signal, and wherein the apparatus according to claim 1 is configured to generate the one or more audio output channels from the audio transport signal depending on the information on the second mixing rule.

13. A method for generating one or more audio output channels, wherein the method comprises:

receiving an audio transport signal comprising one or more audio transport channels, wherein two or more audio object signals are mixed within the audio transport signal, and wherein the number of the one or more audio transport channels is smaller than the number of the two or more audio object signals, wherein the audio transport signal depends on a first mixing rule and on a second mixing rule, wherein the first mixing rule indicates how to mix the two or more audio object signals to obtain a plurality of premixed channels, and wherein the second mixing rule indicates how to mix the plurality of premixed channels to obtain the one or more audio transport channels of the audio transport signal, receiving information on the second mixing rule, wherein the information on the second mixing rule indicates how to mix the plurality of premixed signals such that the one or more audio transport channels are obtained, and generating one or more audio output channels from the audio transport signal depending on output channel mixing information, wherein the output channel mixing information depends on an audio objects number indicating the number of the two or more audio object signals and depends on a premixed channels number indicating the number of the plurality of premixed channels and depends on the information on the second mixing rule.

14. A non-transitory computer-readable medium comprising a computer program for implementing the method of claim 13 when being executed on a computer or signal processor.

15. A method for generating an audio transport signal comprising one or more audio transport channels, wherein the method comprises:

generating the audio transport signal comprising the one or more audio transport channels from two or more audio object signals, outputting the audio transport signal, and outputting information on the second mixing rule, wherein generating the audio transport signal comprising the one or more audio transport channels from two or more audio object signals is conducted such that the two or more audio object signals are mixed within the audio transport signal, wherein the number of the one or more audio transport channels is smaller than the number of the two or more audio object signals, and wherein generating the one or more audio transport channels of the audio transport signal is conducted depending on a first mixing rule and depending on a second mixing rule, wherein the first mixing rule indicates how to mix the two or more audio object signals to obtain a plurality of premixed channels, and wherein the second mixing rule indicates how to mix the plurality of premixed channels to obtain the one or more audio transport channels of the audio transport signal, wherein the method further comprises outputting information on an audio objects number indicating the number of the two or more audio object signals, and outputting information on a premixed channels number indicating the number of the plurality of premixed channels.

16. A non-transitory computer-readable medium comprising a computer program for implementing the method of claim 15 when being executed on a computer or signal processor.

* * * * *